US005545063A

United States Patent [19]

Haynes

[11] Patent Number: 5,545,063

[45] Date of Patent: Aug. 13, 1996

[54] CHAMBERED ANTI-COANDA JET MARINE PROPULSION DEVICE WITH GASEOUS BOUNDARY LAYER FOR A THRUST JET FLOW STREAM EXHIBITING STAGED CONTROLLED BOUNDARY LAYER SEPARATION PROPERTIES, VESSEL TRIM ADJUSTMENT, AND MOVABLE THRUST VECTOR APPLICATION POINTS(S)

[76] Inventor: Hendrick W. Haynes, 17427-195th Pl. SE., Renton, Wash. 98058

[21] Appl. No.: 6,958

[22] Filed: Jan. 21, 1993

[51] Int. Cl.[6] ..... B63H 11/04

[52] U.S. Cl. ..... 440/47

[58] Field of Search ..... 440/88, 89, 38, 440/39, 40, 41, 42, 43, 47; 60/221, 222

[56] References Cited

U.S. PATENT DOCUMENTS

| | | | |
|---|---|---|---|
| 3,292,373 | 12/1966 | Tado | 440/38 |
| 4,023,353 | 5/1977 | Hall | 440/38 |
| 4,239,013 | 5/1982 | Haynes | 440/38 |
| 4,450,820 | 5/1984 | Haynes | 123/514 |
| 4,611,999 | 9/1986 | Haynes | 440/47 |
| 4,979,917 | 12/1990 | Haynes | 440/38 |

*Primary Examiner*—Stephen P. Avila

[57] ABSTRACT

A marine propulsion system for use as a driving means and a progressive hull resistance characteristic changing means is herein described. The drive can develop a separation of the jet water stream flow field from the vessel hull, as well as separate the supporting ocean water flow field from the hull. The jet system air cavity doors also act as trim planes and hull planing (hydrodynamic) surface structures, and as thrust vector application control valves (in this capacity, they have the capacity to reduce drag . . . and make a vessel go faster, as well as increase it . . . by varying Coanda effect and hull plate fluid friction). The unit can be used in conjunction with an automated controlling device (such as a computerized control linked to servo motors, feedback potentiometers, and linkages) wherein a specific power-up and power-down sequence can be followed in response to sensor information. It can allow the placement of a jet pump lower in the vessel, thus reducing suction lift and wasted hydraulic head pressure losses to the nozzle point.

15 Claims, 31 Drawing Sheets

CHAMBERED ANTI-COANDA JET MARINE PROPULSION DEVICE WITH GASEOUS BOUNDARY LAYER FOR A THRUST JET FLOW STREAM EXHIBITING STAGED CONTROLLED BOUNDARY LAYER SEPARATION PROPERTIES, VESSEL TRIM ADJUSTMENT, AND MOVABLE THRUST VECTOR APPLICATION POINTS(S)

BACKGROUND OF THE INVENTION

This application relates to an "anti-Coanda" effect drive, and its use on craft which must perform well at low speeds as well as high speeds. It relates to the placing of a gaseous boundary layer of air between a high velocity stream or layer of water and the hull plate surface and therefor remove in (some measure) its form and area from the resistance. Further, it relates to changing the effective vessel hull form by using the anti-Coanda effect flaps or doors as trim tabs and extendable planing surfaces, and by varying the relationship of the thrust jet stream nozzle area to Corona-Jet gas cavity area, and to vary and selectively relieve suction pressures on the hull (as well as create regions where the hull pressure is raised) in response to a specific operational need. The unit can be used in conjunction with an automated controlling device, such as a computerized control, wherein a specific power-up and power-down sequence can be followed in response to sensor information and specific target parameters that may be achieved as bench marks.

The subject invention deals with anti-Coanda effect boundary layer separation systems. One such hull structure device is an anti-Coanda effect submerged discharging marine jet nozzle propulsion device. Another would be the same device without the jet nozzle located therein, e.g., a pressurized gas cavity or hull "step" useful in establishing a maintainable layer therefrom utilizing the same cavity principles as herein disclosed. Another would be the same devices as above with the flaps or doors useful as extendable trim tabs and planing surfaces, wherein a pressurized gas cavity or hull "step" useful in establishing a maintainable gaseous boundary layer therefrom is established. These cavity types could be located adjacent to each other, and could (although not necessarily so) share the same gas source. Further, they could be activated at and over the appropriate vessel speeds (and the streamlining hull closure flap or door deployed to its best position) to optimize the performance criteria then important (either vessel slowing down or stopping . . . or toward the best transportation efficiency), or in maintaining stability (yaw, pitch, and roll) in a seaway.

The subject invention deals with the anti-Coanda boundary layer separation system used over a broad speed range, wherein the application of the system can be seen to be useful both as a simple drive for displacement craft, in application on variable geometry displacement/planing craft, and on hydrofoil craft wherein the jet performance of a submerged anti-Coanda effect jet is acceptable in coming up to vessel foil lifting speed. Further, the subject invention deals with performance improvements resulting from the placing of the marine jet propulsion system low in the vessel with respect to the water line, and its implications on specialized high speed craft (such as hydrofoil craft, wherein performance losses can be reduced by reducing the pump suction lift, hydraulic head, and lowering the jet nozzle thrust application point toward the hydrofoil centerline of hydraulic drag). Potential, therefore, exists to substantially reduce pump suction and pressure head losses (and deliver the change as improved thrust) and vessel hull resistance (either as foil born and or hull born craft), and thereby increase vessel speed for the amount of power applied.

The subject invention deals with both displacement water craft, and water craft which can be made to perform with good efficiency as both displacement and planing craft (a variable geometry stepped hull can be created depending on "door" location and deployment-at-speed sequencing).

The subject invention deals also with flap or door closure logic, wherein the magnitude and direction of the jet applied thrust may be changed at the point of discharge, and the hull resistance varied at speed, by changing the geometry of the jet discharge (vary jet stream velocity) and the opening size of the Corona air chamber (vary the air supply pressure and the region of hull boundary layer influence). Further, the point at which the thrust can be applied can be controlled through door closure logic, and to the degree (or angle) to which the doors are deployed (and potentially trim influenced), the performance of the vessel optimized through the use of appropriate feedback instrumentation.

Inboard auxiliary or main drive engines which use directed water for propulsive power, such as propellers and marine jets, develop thrust by the transfer of momentum, e.g., the ejection of water away from the boat system. With propeller drives and submarine discharging jets located submerged near the hull, the ejected water drags other water with it and influences the water flow about the hull. This "dragging" of water into a changed path about the hull takes applied thrust away from that available for driving the hull forward. A negative pressure zone of influence is created against the hull, and this in measure cancels a portion of the thrust capability of the propulsive device. Further, by virtue of the propeller or jet nozzle angle and its location, this can affect the direction of applied thrust, the amount of thrust applied in the direction of interest, and the trim of the vessel (and the power lost) in correcting for the thrust application point and direction by foil means (rudder, trim tab, flap, hydrofoil, another driving source, or similar devices).

Further, the unit may be useful on "Flying Boat" aircraft, wherein the aircraft has a hull which is a vessel that must operate efficiently at both displacement and planing speeds. Further, it can be used on hulls which operate above as well as in the water, such as hydrofoil craft. Further, it can be used on submerged hull type craft, such as SWATH (Small Water Plane Twin Hull), "wave piercing" craft, and fully submersible craft.

The propensity for a moving fluid to follow a curved surface it is flowing against is known as the "Coanda Effect". Coanda effect can also be observed on a local or micro level with a flat plate, wherein the fluid couple or attachment between the plate and a moving parallel fluid will be locally disrupted into a curved path. This local disruption in an otherwise ordered flow path is transferable to adjacent streamlines at a rate dependant on the degree of inter streamline couple (e.g., a curved or vortexing path adjacent to the hull plate of a moving vessel). To create an anti-Coanda device, therefor, is to create a means to work against the inter plate and inter fluid streamline couple.

Thrust lost through a propeller or water pumping device as compared with its test tank "model" test is composed of changes (powered vs. unpowered vessel) in a) flow fields of the water pumping device due to installation in the vessel, b) modification of the vessels frictional and eddy drag characteristics due to the water pumping devices changes in the vessels boundary layer flow path at speed, c) modification of the vessels wave making, and d) Coanda effect losses. The total of these losses is called the "thrust deduction factor", or TDF. Simply stated, the thrust fraction (t) lost is the difference between the thrust required to free tow an unpowered vessel at speed as apposed to the shaft thrust required to push the vessel with the propulsor installed. The thrust fraction lost can range from a loss of a few percent to over 50 percent depending on the propulsor and the installation. TDF can be measured by subtracting the VESSEL ENGINED MEASURED THRUST (VEMT) from the IDEAL FREE UNPOWERED VESSEL TOW THRUST (IFUT) or vessel system model tow thrust, and dividing this by the IFUT. This fraction, representing thrust CONSERVED, must be subtracted from 1 and multiplied by 100 to yield percent loss, e.g.,:

$$T \text{ percent loss}=1-\{[(IFUT-VEMT)/IFST]-1\}\times 100$$

The remaining thrust, or actual propulsive thrust, acts to drive the hull into equilibrium with hull resistance as the vessel accelerates to speed. The above assumes a high order of correlation between "model tests" and historical sea trials data. Ideally, IFUT is from a full scale model test.

The total thrust required to drive a vessel at speed, e.g., Thrust Horsepower (THP) is equal to the shaft thrust required to overcome the unpowered Ships resistance at speed (Sr). The NET horsepower driving the vessel is the EFFECTIVE horsepower, or EHP. More accurately defined, $$THP=\{T\times[Vk(l-w)]\}/325.6$$

$$EHP=[T\times Vk\times(l-t)]/326.6$$

$$Hp.\ \text{lost}=THP-EHP=(THP)\times t$$

Where:

T=Propulsor thrust in lbs.

Vk=Speed of ship through water in knots

Va=Propeller speed of advance in knots t=Thrust Fraction (1–t)=Thrust Deduction Factor w=wake fraction where $$(\text{Taylor})w=(Vk-Va)/Vk=1-(Va/Vk)$$

The resistance due to the ships underwater profile is composed of Frictional Resistance, Eddy Current Resistance, and Wave Making resistance. The subject invention operates to reduce thrust deduction factor (TDF). The subject invention operates also to reduce the vessels "free towed" driving thrust requirements by reducing the vessels stern wave making and stern hull resistance (due to local frictional and eddy current) properties. The subject drive not only reduces the influence of propulsion system water flow effects on the hull form, but also can changes the "effective" hull shape under the influence of a fluid flow about the vessel after body.

This requirement in terms of after body shape changes with speed, as the after body plate angle (or shape) and internal buoyancy become progressively more important as the vessel speed is reduced. Similarly, as speed is increased, the after body plate angle requirements change. This can be sensed by sensors and corrections made.

The invention herein described is related primarily to submerged discharging water pumping systems used for powering marine vessels, such as a submerged discharging marine jet pumps. It is also related to providing steps, of variable size, in the hull wherein is contained an air or gas supply manifold. It is also related to connecting the submarine discharging anti-Coanda effect jet and the variable anti-Coanda effect steps together in a cooperative way such as to allow separation of the fluid flow field away from the after body of the vessel hull. It is also related to providing variable pressure or planing surfaces on a hull or hulls.

The subject invention provides a means wherein heat from the motor or engine can be used to provide gases for surrounding the ejected submerged discharging jet stream for providing increased net propulsive thrust. Also, the motor or engine waste or exhausted gases can be vented around the outside of the ejected jet stream and/or for providing a gas flow for relieving the suction on a hull step. Alternately, ambient air may be supplied to produce the gaseous boundary layer surrounding the jet stream and against the submerged surfaces of the vessel hull. Alternately, the gas supply to the subject invention may be supplied by a separate chemical gas generator means or compressed gas supply. The gas supply can be valved (for manual and/or automatic operation) to vary the extent of supply to the Corona air charge region, and hence affect the pressure ratio in that region (see FIG. 23).

The gases provided surrounds the submerged water jet or water stream and flows up against the vessel hull and/or flows with the jet or water stream away from the hull. This develops a barrier layer which expands and provides a low average kinematic viscosity shearing layer around the jet stream and against-the-hull, thus working to reduce the gross propulsion system effort in thrusting the vessel forward (as to be hereinafter further explained), and in acoustically isolating the thrusting system (isolating propulsion system and jet discharge noise). Further, this gaseous boundary layer or shearing layer, besides increasing net propulsive thrust and through the modification of the vessels resistance properties, increases boat speed, it also significantly reduces changes the tonal characteristic and amount of noise transmitted into the water.

At very low speeds, this gaseous boundary layer rises against the curved after body of the hull, and provides an imbalance in the vector field of the hull favorable to the vessels forward movement. As the vessel moves forward faster, the rate at which this gaseous field rises no longer contributes to the forward movement of the vessel, and is useful only in fluid field separation from the hull. The vessel therein looses buoyancy in the wake field in which this flow operates. The submarine discharging jet flap or door is then deployed much like an airplane flap, e.g., to act as an after plane of hydraulic support structure, thereby correcting for adverse vessel trim. As the vessel goes faster yet, the water flow velocity on the hull surface can be fast enough that other doors (ventilated by a gas cavity) can be opened, and progressively other resistive portions of the hull coated with a gaseous layer . . . and the buoyant force reduction corrected for by door or flap deployment. As the vessel goes faster yet, the curved form of the after body has been completely separated from the fluid stream and, by flap angle, corrected for . . . and the hull form thereby becomes a semi-planing or planing hull form.

The change in the vessel balance utilizing the above strategies must be taken into account during vessel and system design. The shift in the vessel center of mass with respect to the center(s) of hull support can also be corrected for by appropriate door deployment. Best results are achieved by proper design and location.

The above drive may be useful in applications requiring a broad vessel operational profile, wherein they must operate slowly and with great quietness and unobtrusiveness (stealth), and must then respond also with periods of great speed (such as in types of hydrofoil passenger craft, fishing craft, police type interdiction craft, and in certain types of warfare operations.

To reduce parasitic hull drag and deterioration of jet efficiency by marine life growing inside the jet pump, and for closing of the jet openings to lower hull resistance when the jet system is not in use (when the jet is a power augmentation or auxiliary power source), streamlining and sealing hull closures are incorporated (wherein the flaps or doors are closed or retracted to hull form). The jet system may be used as an auxiliary or thrust augmentation source on vessels which sail, on military and maritime vessels which have as their main power system a fixed blade or controllable pitch propeller system (and as a prime mover in its own right). The aforementioned system may be used as a propulsion system, as well as a bow thrusting system, or partially as a localized thrusting system or a means for ventilation of a variable hull portion or step.

OBJECTS AND ADVANTAGES

It is an object of this invention to provide a means of propulsion utilizing a water jet drive adaptable for operation both above and below the surface of the water with close to the same net thrusting capability.

It is an object of this invention to provide a means of propulsion utilizing a method of power application wherein the resistance of a vessels movement through the water may be lowered, thus allowing propulsion systems of lower net thrust to drive the vessel at speed.

It is an object of this invention to provide a means of propulsion, for powering a marine craft, with a lower under water noise signature than is available with conventional designs unaided by the subject invention.

It is an object of this invention to provide a means whereby engine waste heat may be recovered and converted into gases useful in surrounding the discharged water jet stream which propels the vessel, and the after body of the vessel, thereby increasing net system energy conversion into propulsive thrust, and vessel speed, and also reduce the propulsion noise signature.

It is an object of this invention to reduce the power plant exhaust gas infra-red emission signature.

It is an object of this invention to disguise or hide the smoke emission signature of the power plant or engine by burying it in the vessel wake.

It is an object of this invention to provide a means whereby a gaseous boundary layer is provided around the ejected water flow stream of a submerged discharging water jet and/or the vessel hull, wherein this gaseous boundary layer provides a region of shear that isolates the water output jet flow and the water against the hull (thereby breaking the couple between the hull and the flowing water).

It is an object of this invention to provide a means whereby a gaseous boundary layer is provided around the ejected water flow stream by an isolated gas source means, such as compressed gas in a bottle or a chemical reaction chamber resident on the vessel, or by a reactor means.

It is an object of this invention to provide a means whereby the hull contours may be altered by moveable flaps or doors, and the gaseous boundary layer controlled in the wake of these devices, and thereby the resistive and lifting qualities (vector fields) of these regions can be selectively controlled at the discretion of the vessel operator, or suitably programmed controller device (such as a computer).

It is an object of this invention to provide a propulsion means which may be incorporated in a vessel also using another means of propulsion.

It is an object of this invention to provide a propulsion means which may be sealed off through the use of streamlining sea closure doors placed at the intake and outputs of the propulsion means, and thus reduce the parasitic drag associated with using the subject propulsion means and also protect the subject propulsion means interior from intrusion by marine growth and debris.

These and other objects and advantages shall become apparent from the following description taken in conjunction with the accompanying drawings in which:

THE DRAWINGS

FIG. 1 is a cross-section of the propulsion unit taken on line 1—1 of FIG. 9, showing the passing of gases or gaseous layer against-the-hull and surrounding the jet stream 48, and door or flap 123 deployed to optimize the gaseous boundary layer around the jet stream and against-the-hull, as well as effect vessel trim.

FIG. 2 is a detailed cross-section of the motor heat exchanger and jet pump combination for the transfer of rejected heat into the pump jet stream as an embodiment.

FIG. 3 is a detailed cross-section of the obliquely angled jet output of FIG. 1 around which gases from either ambient air or a charged gas source (such as a bottle of compressed gas, a steam generation source, a gas source generator and/or engine exhaust, and/or other known means) is introduced to surround the output jet stream and flow against the hull surface. A sea closure door is shown in two positions, e.g., closed or streamlined to the hull . . . and deployed such as to act as a hydraulic planing surface and to effect a change in vessel trim at speed.

(FIG. 18A: position 1, thrusting aft; FIG. 18: position 2, thrusting toward port side, reaction to starboard).

Figure 19:
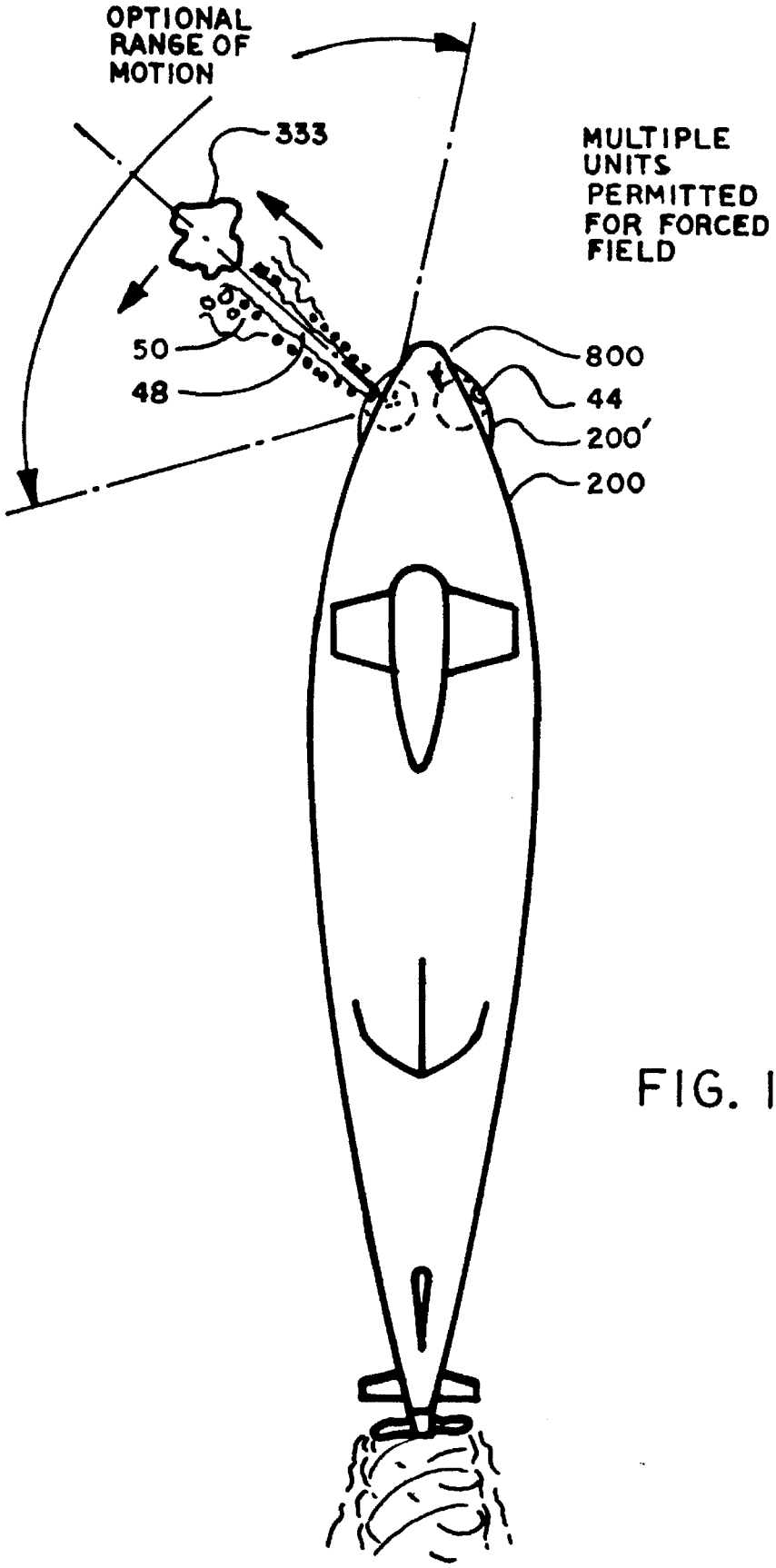

FIG. 19 is a plan view of a surface craft, such as a surfaced submarine or destroyer, operating the thruster in a counter measures operation. Water jet nozzles are discharging gaseous jacketed thrust streams through optional rotateable hull plates (see also FIG. 14) for driving off surface ice and debris. Similarly, it can be used to skim or herd surface oil in a spill, and gather same between hulls of a catamaran.

Figure 20:
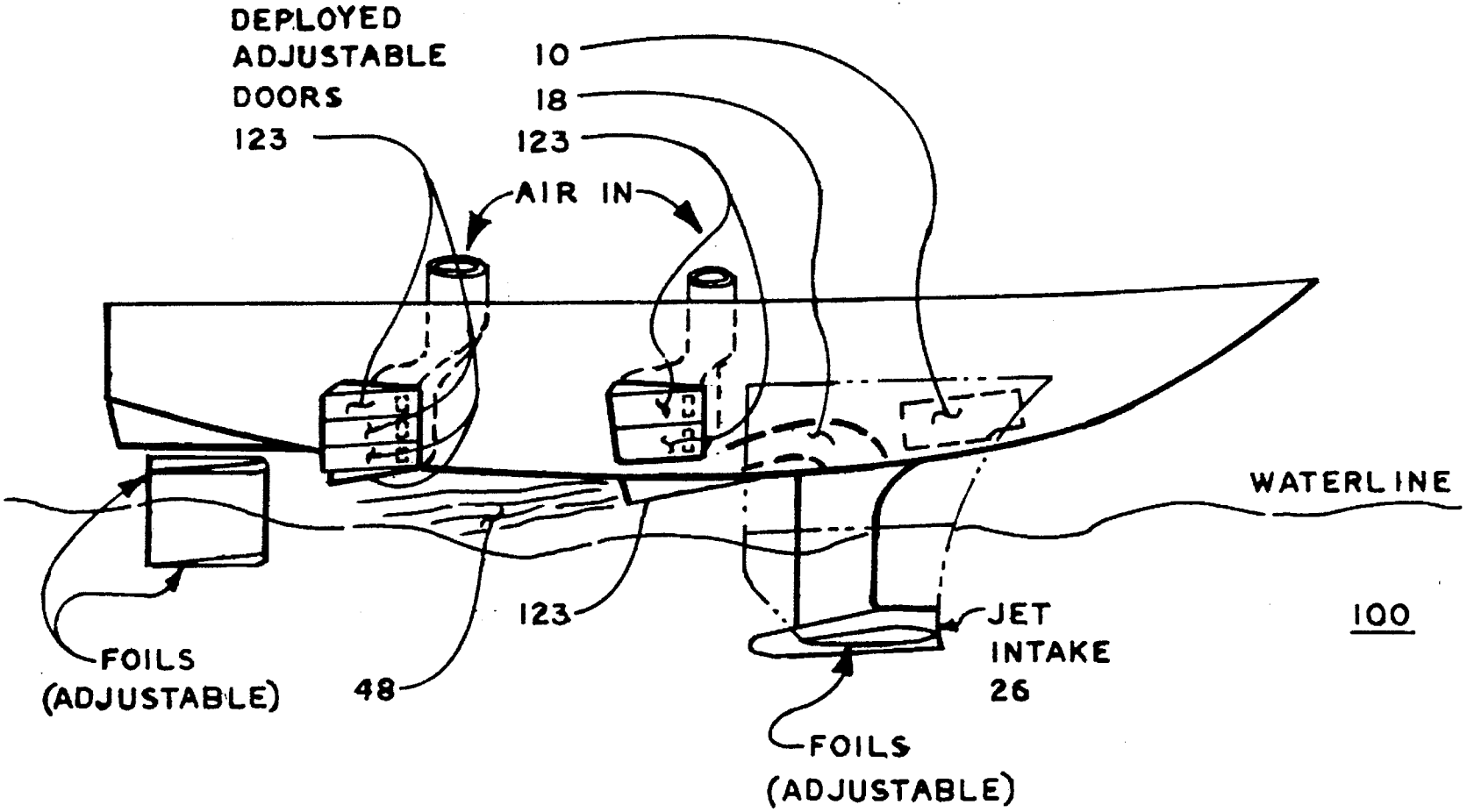

FIG. 20 is a view of a multimission craft, such as a hydrofoil craft, showing the position of the water jet drive, and the ventilated variable geometry "flap" planing steps (with air supply chambered bulkhead or manifold). This single hull craft can have multiple hulls, such as a catamaran or trimaran, with nozzle and flap structures located for desirable thrust and pressure concentration points and areas.

Figure 21:
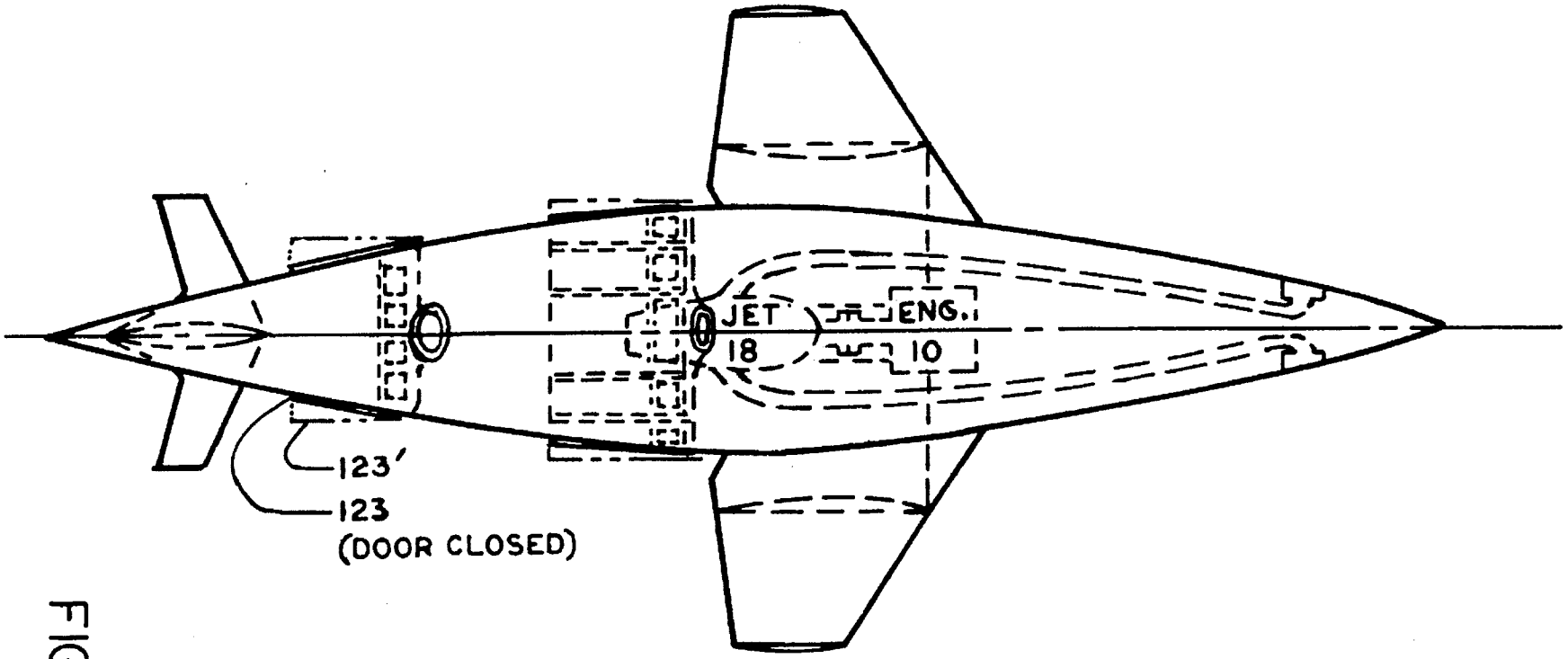

FIG. 21 is a plan view of a multimission craft of FIG. 20, showing the position of the water jet drive, the bow thruster nozzles (optionally also stern thrusters), and the variable geometry "flap" planing steps.

Figure 22:
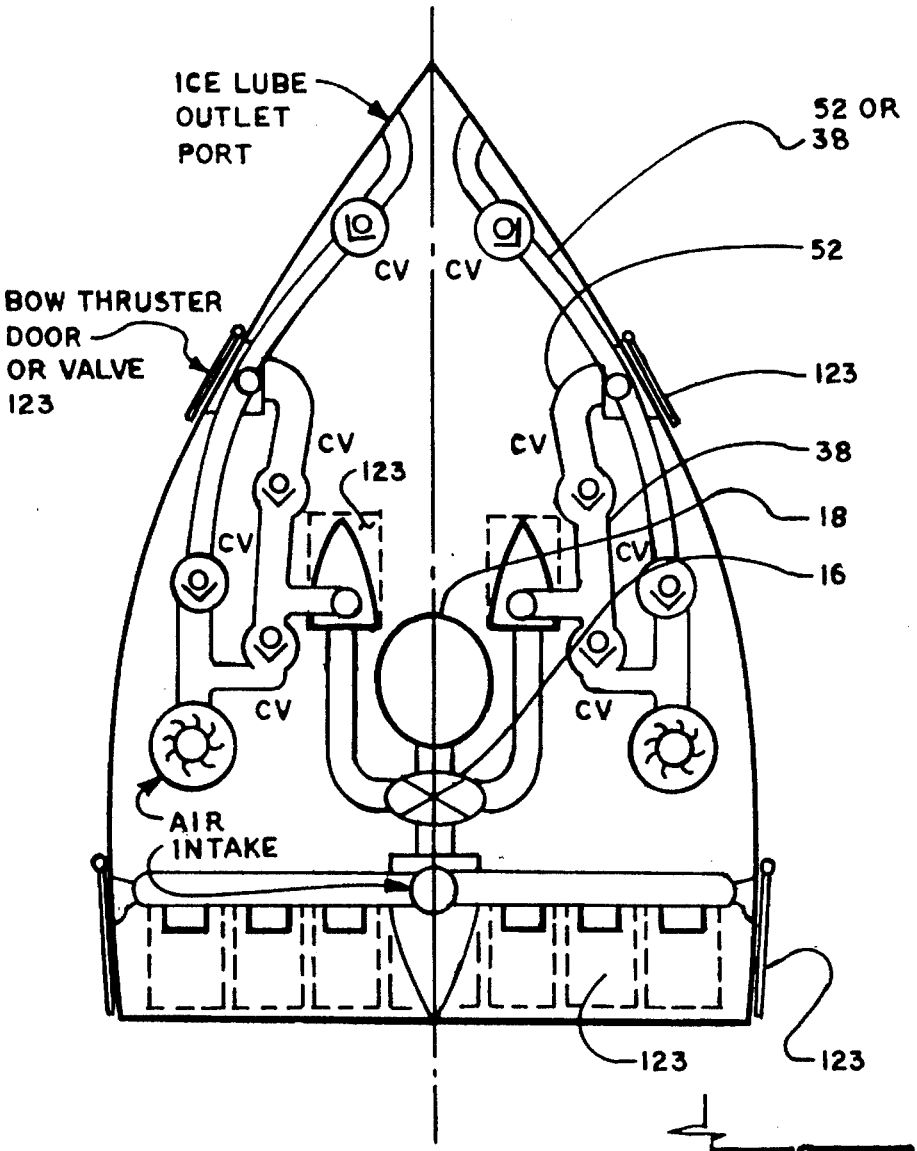

FIG. 22, is a schematic diagram of door and valve logic for utilization of the Corona-Jet air passageway ducts for application of thrust and drag to select portions of the hull.

Figure 22A:
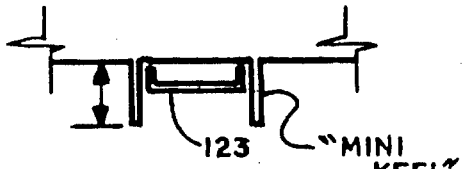
Figure 22B:
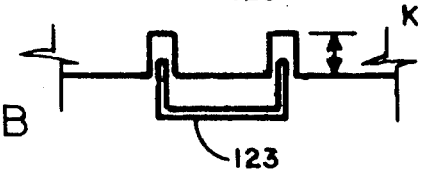

FIGS. 22A and 22B are views of the door or flap between adjacent "mini-keel" members.

FIG. 22A is a door or flap between adjacent members.

FIG. 22B is a door or flap which is like a "U".

Figure 23:
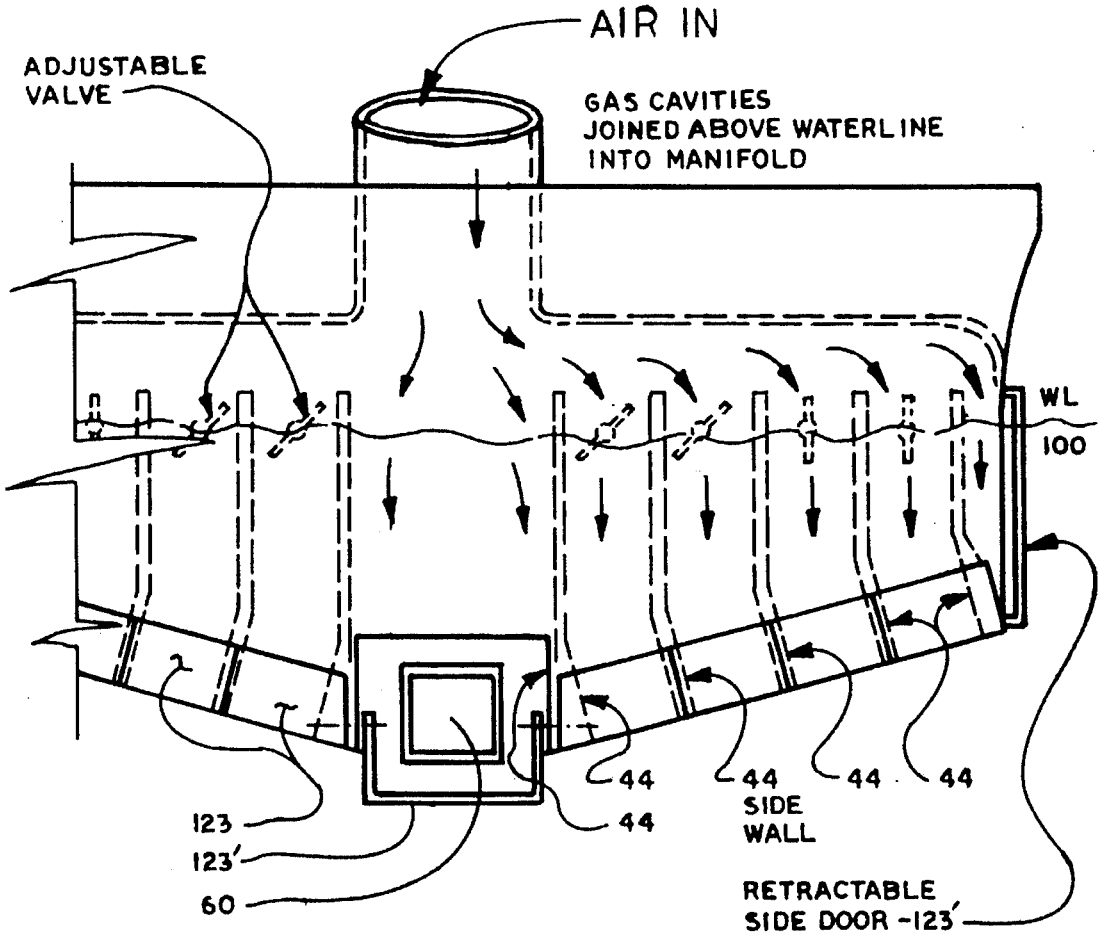

FIG. 23 is a view from stern of a vessel hull full water line width, showing the Corona Jet cavity partitioning zones within the cavity and the optional joining of the air supply above the water line.

Figure 24:
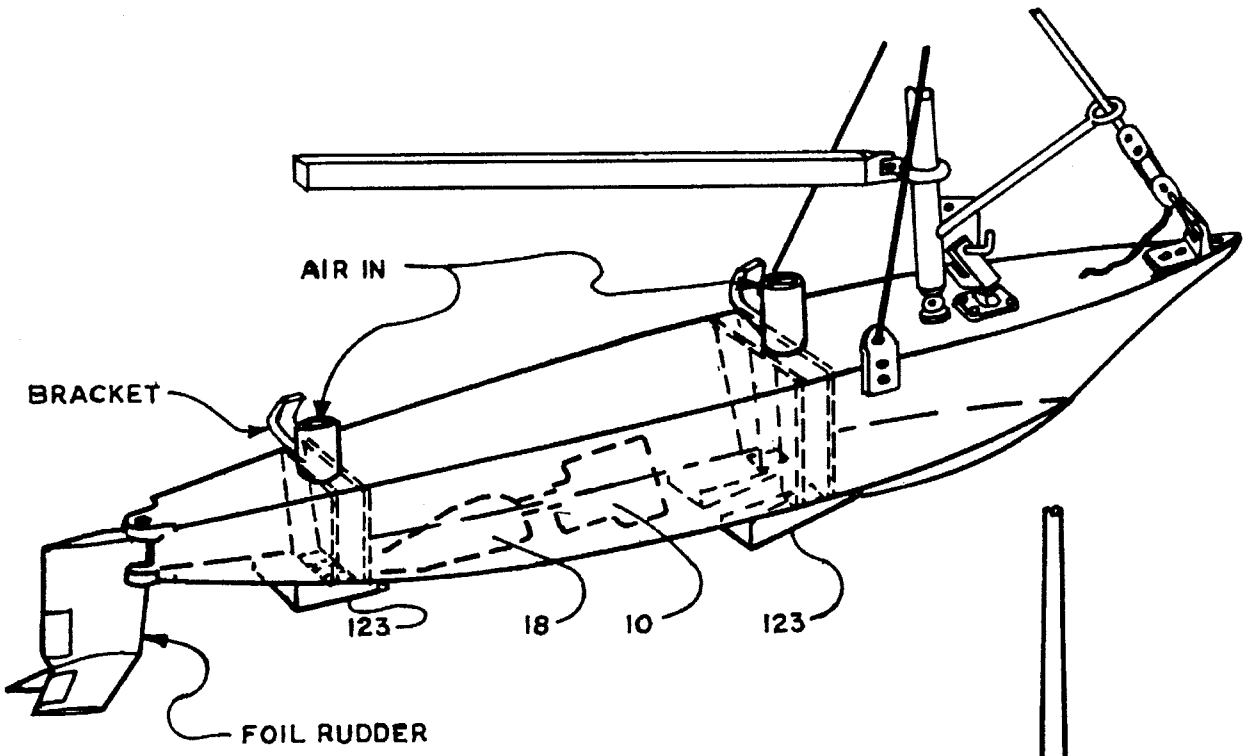

FIG. 24 is a perspective view of a hull wherein two door location planes are shown, similar to FIG. 20. In this case this can be a catamaran sailboat hull with a pivoting or lowerable mast. The vessel center of mass is not shown, but by inspection it can be seen that the center of hull support pressure can be changed by pressure exerted by the door(s) and/or foil.

Figure 24A:
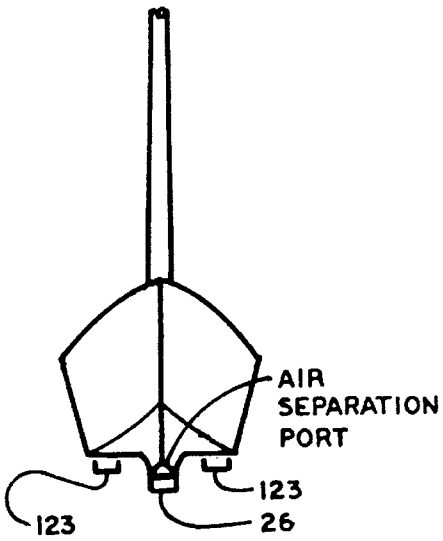

FIG. 24A is a partial bow-on view (front view, detail simplified) showing extension points of the front doors 123 and the relation of the extended keel containing the jet intake and air separating heat exchanger means.

Figure 25:
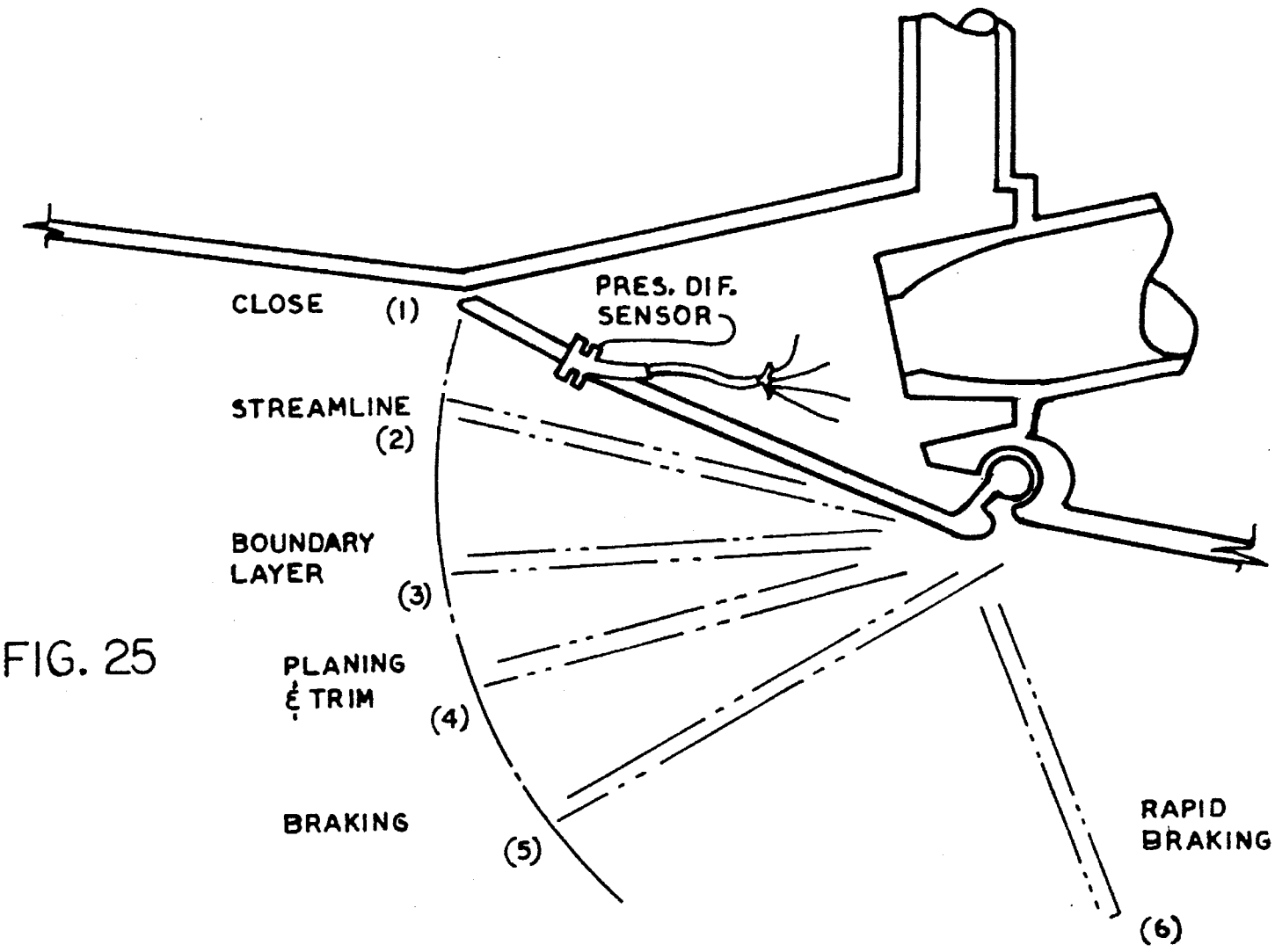

FIG. 25 is a cross sectional view of a Corona cavity showing possible door option positions of "close", "streamline boundary layer planing and trim", and "braking" or "rapid braking".

Figure 25A:
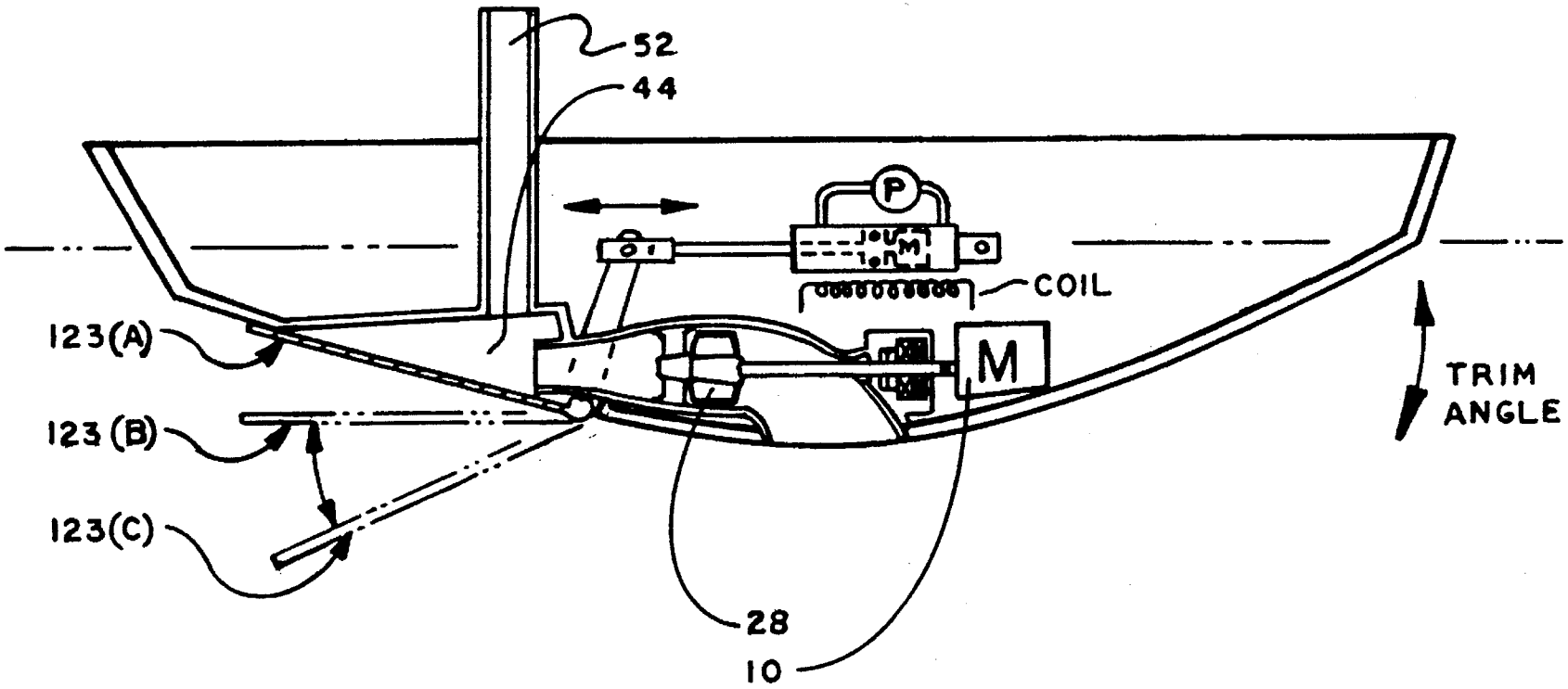

FIG. 25A is a cross sectional view of a Corona cavity showing possible programmed door option positions, and a positioning means such as a hydraulic cylinder with lever and linkage means for activation.

Figure 25B:
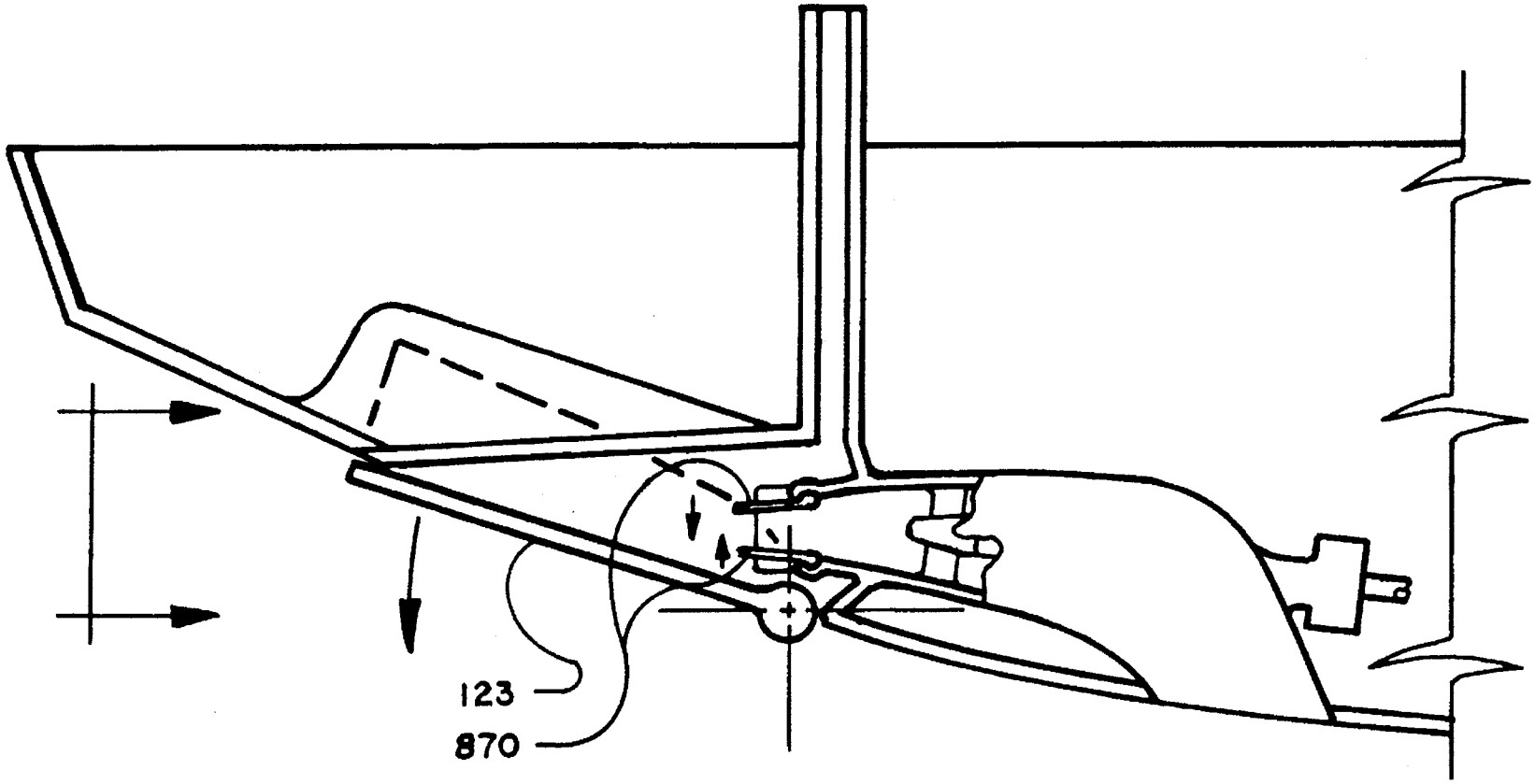

FIG. 25B is a cross sectional view of a Corona cavity showing possible nozzle flap movement (between rectangular plate surfaces) and Corona door movement. Water jet stream velocity characteristics are important to proper Corona discharge stream development.

Figure 25C:
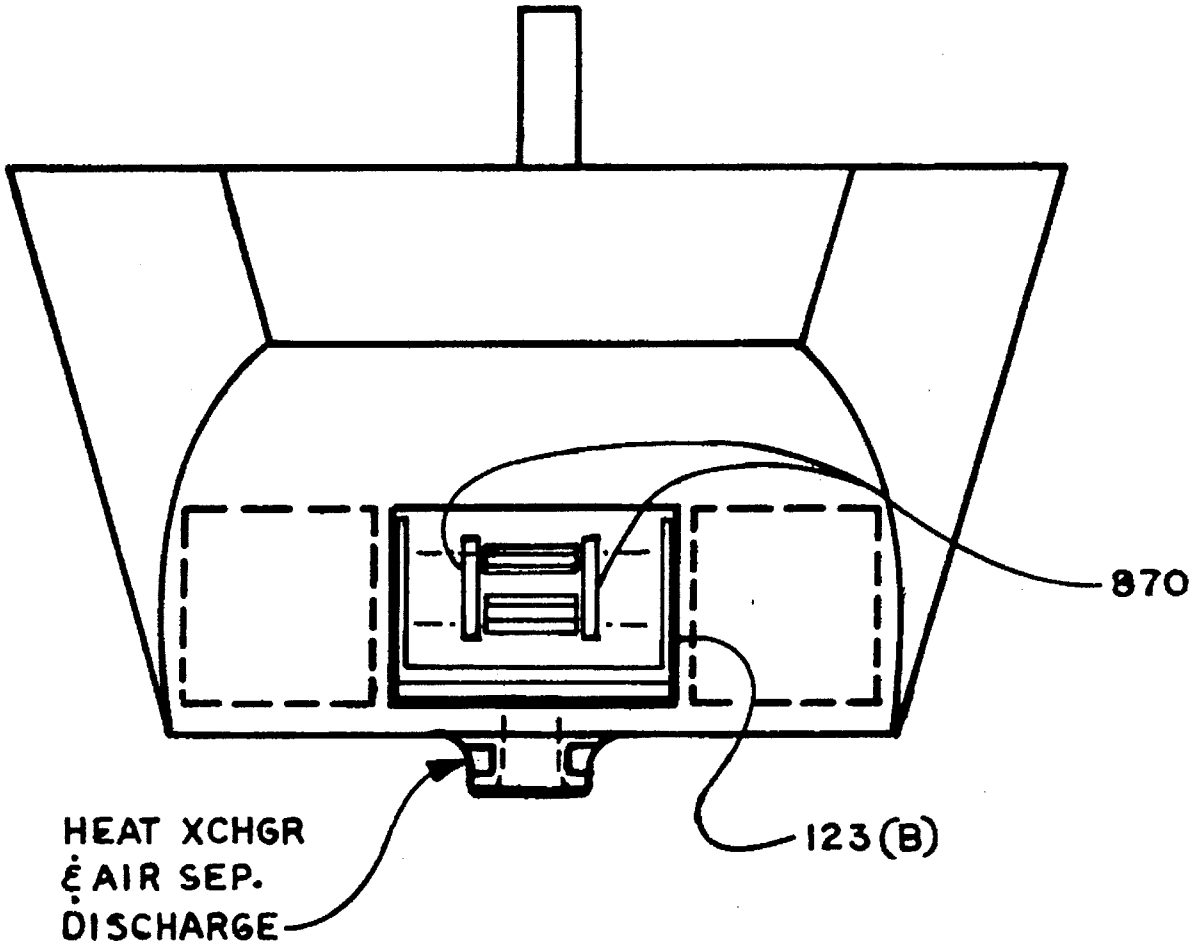

FIG. 25C is an end or transom view of a Corona cavity with center door open. The rectangular moving nozzle plates are shown. Adjacent Corona doors are indicated in dashed lines. The keel shoe jet intake point is shown, as well as downstream discharge point of the air separator/heat exchanger system.

Figure 25D:
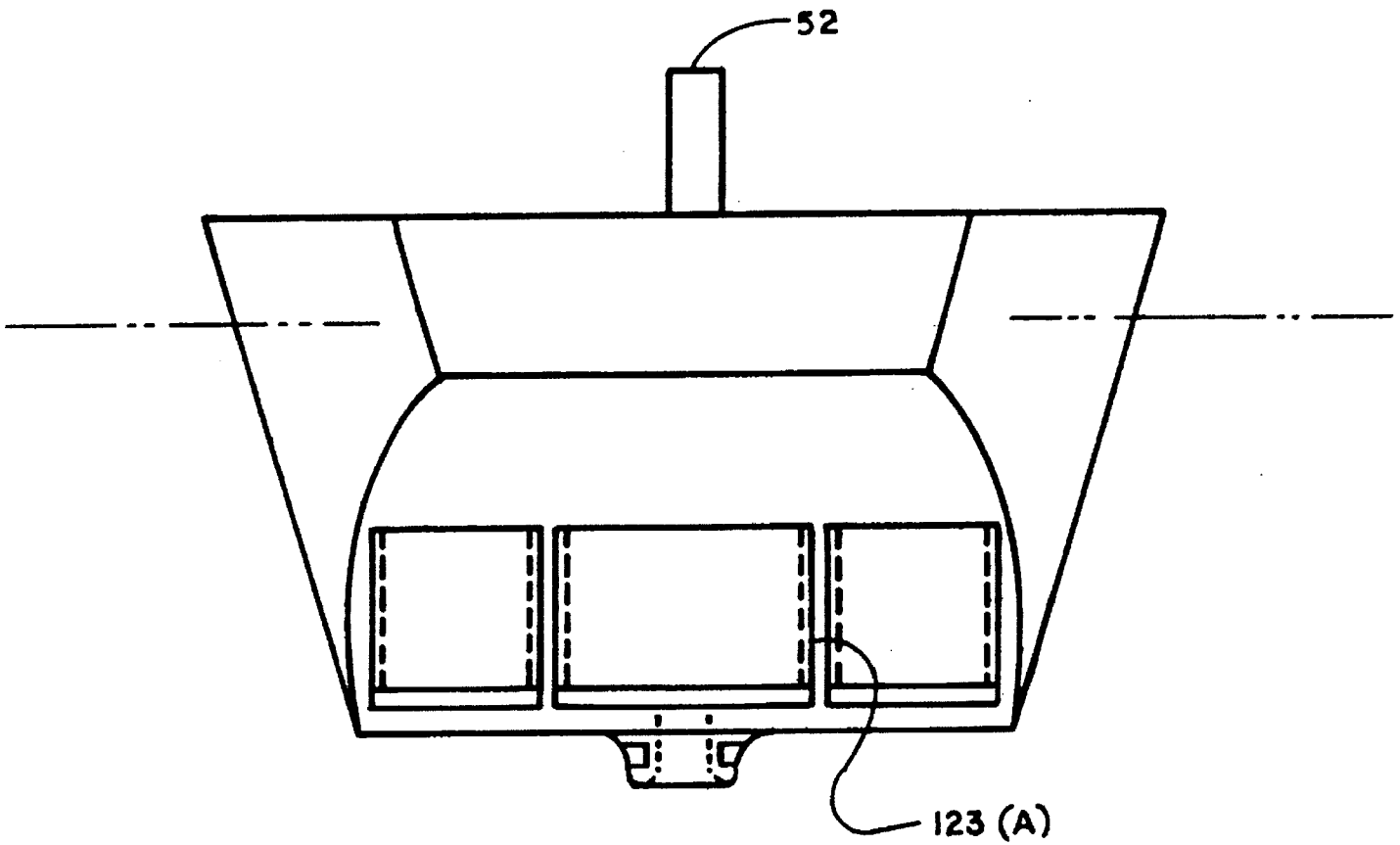

FIG. 25D is an end or transom view of a Corona cavity showing all doors closed.

Figure 26:
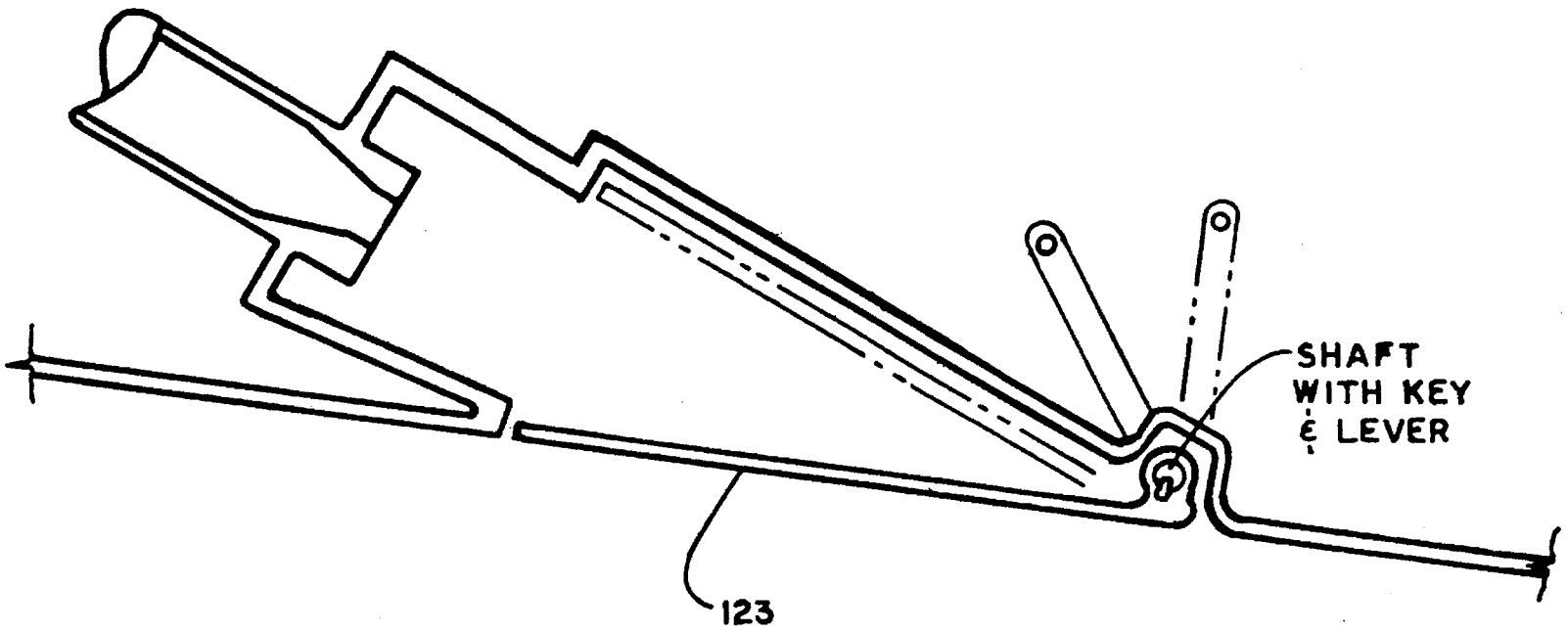

FIG. 26 is a partial cross sectional view of a Corona cavity door showing the option of a door (such as on a reverser through-hull) pulling into the hull.

Figure 27:
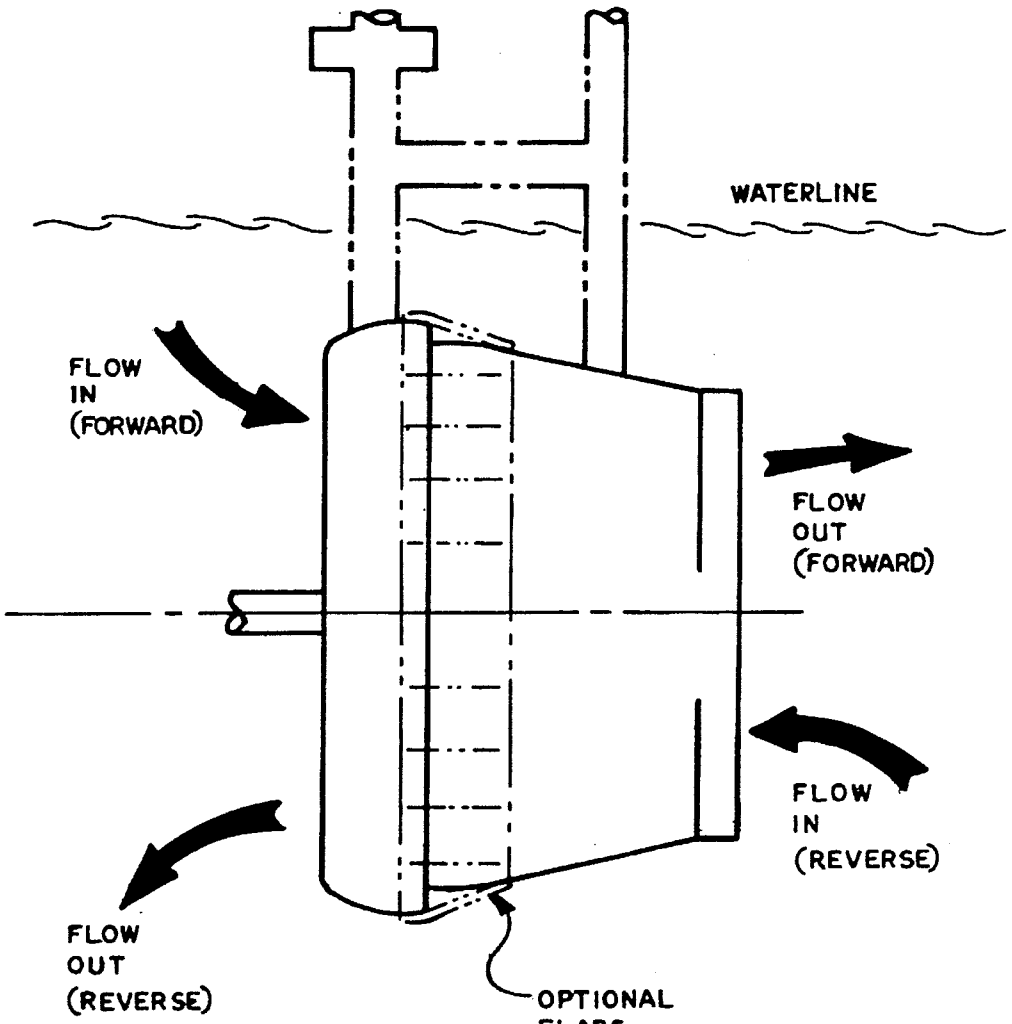

FIG. 27 is a profile view of a Kort Nozzle, with the subject invention anti-Coanda cavities and controling means installed thereon.

Figure 28:
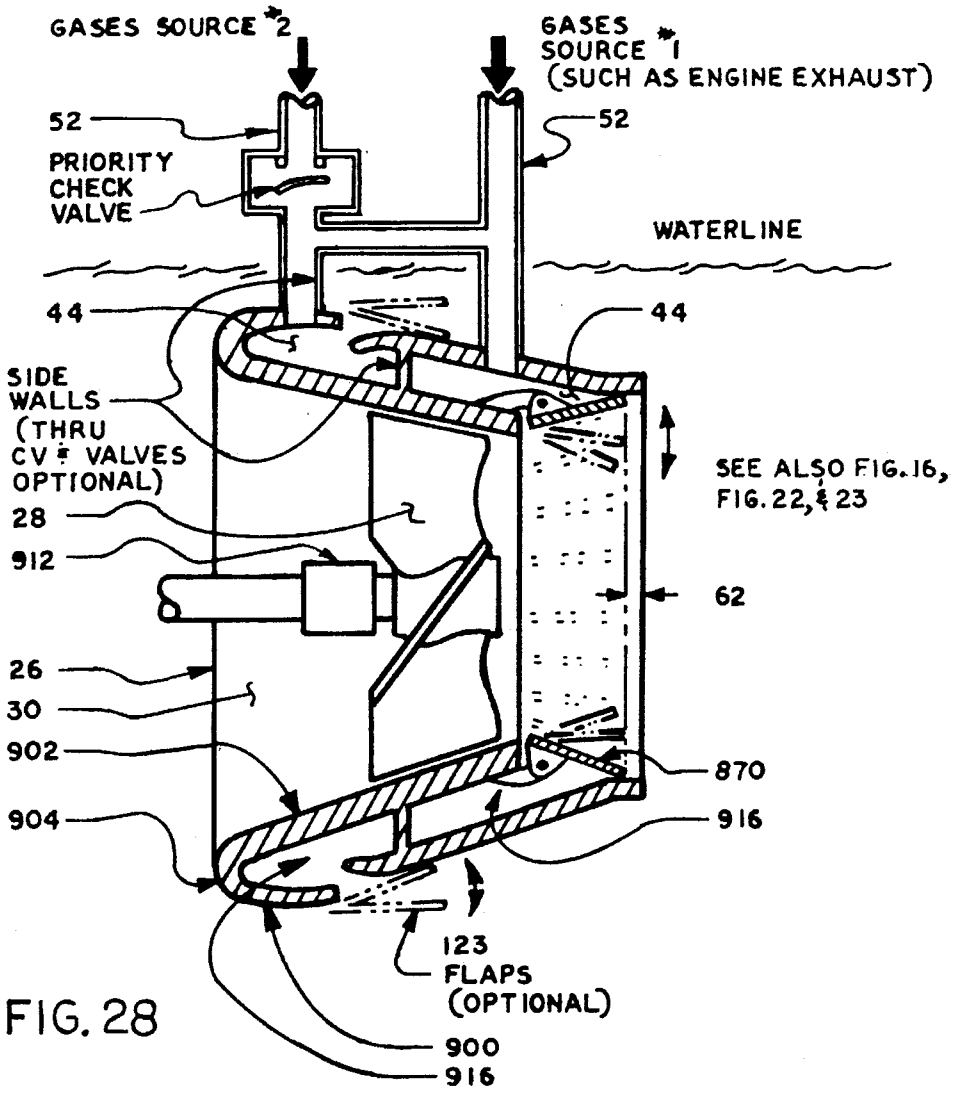

FIG. 28 is a partial cross section of FIG. 27 (in profile) showing an approximate shroud shape and chamber and gas cavity locations. Approximate range of motion (of moveable portions) is indicated.

Figure 29:
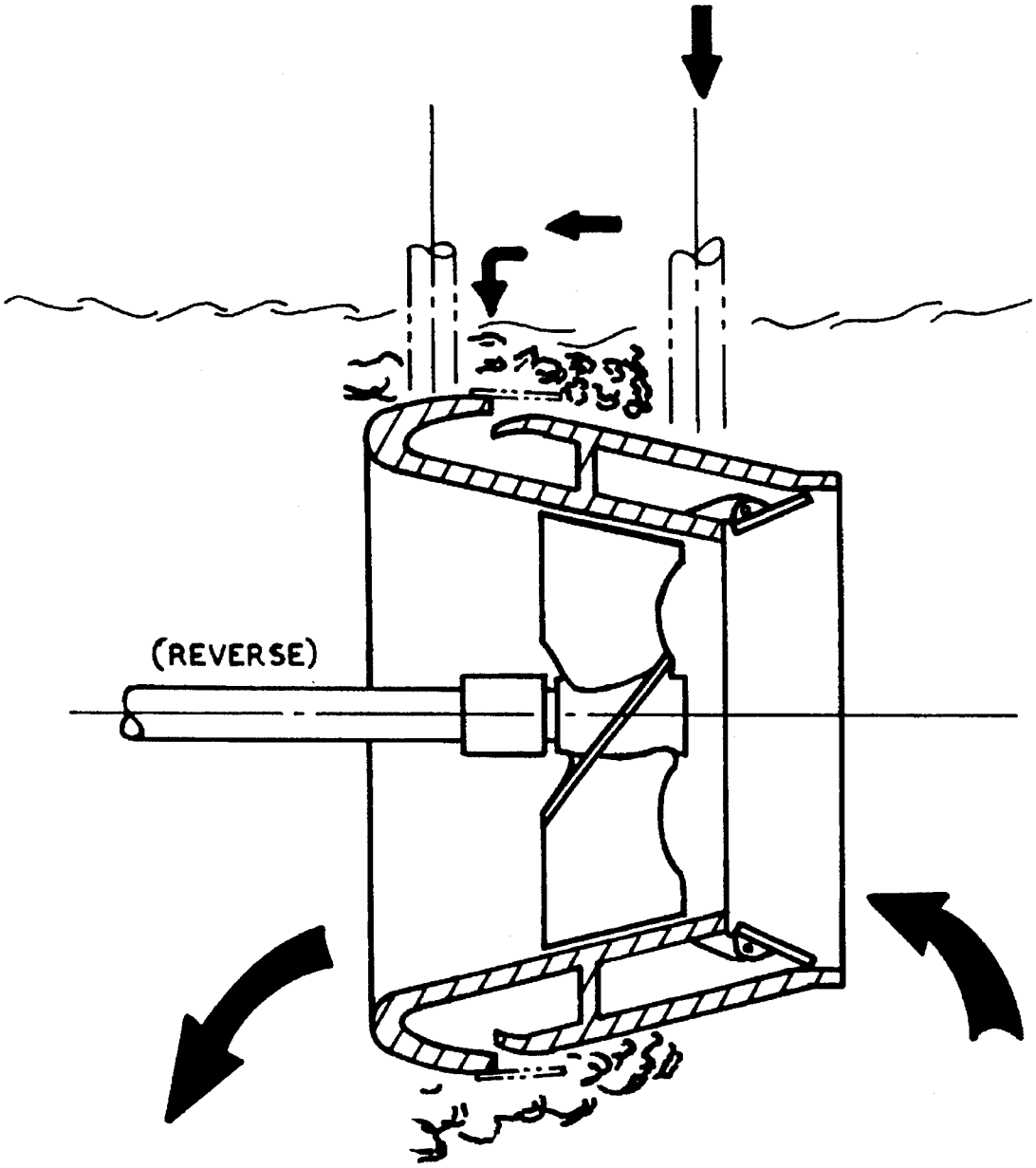

FIG. 29 is a cross section of FIG. 27 (in profile) showing the prefered flap and valve position for REVERSE THRUST (propeller or impeller rotating backward).

Figure 30:
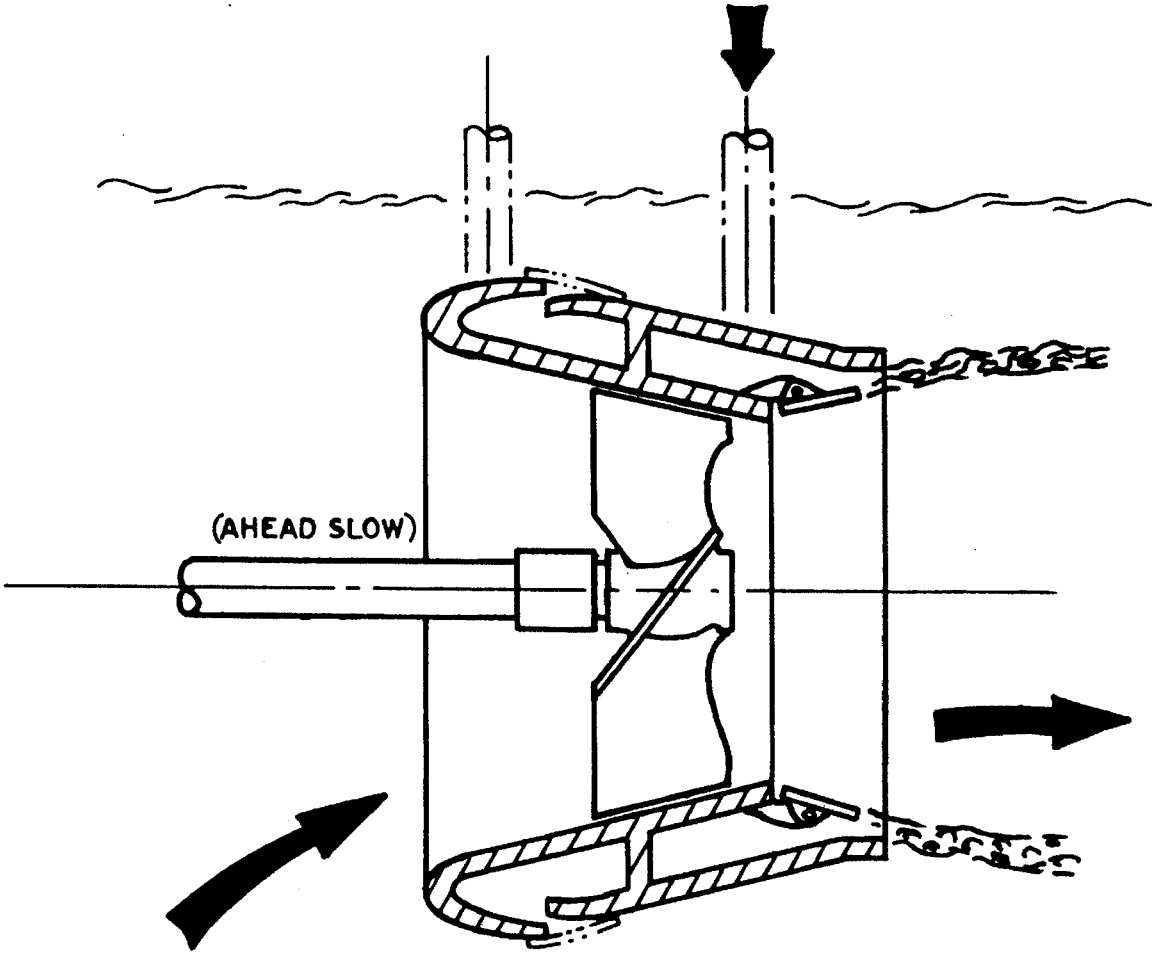

FIG. 30 is a cross section of FIG. 27 (in profile) showing the prefered flap and valve position for AHEAD SLOW FORWARD THRUST (propeller or impeller rotating forward).

Figure 31:
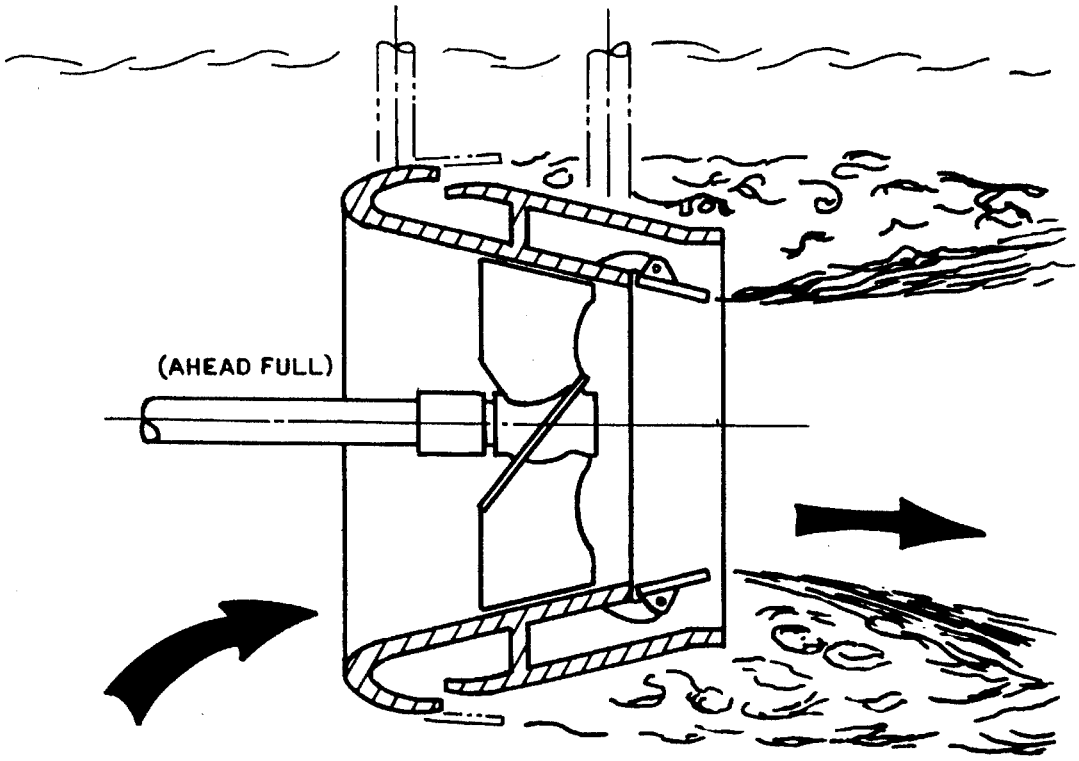

FIG. 31 is a cross section of FIG. 27 (in profile) showing the prefered flap and valve position for AHEAD FULL FORWARD THRUST.

SPECIFIC DESCRIPTION OF THE INVENTION

This application represents a work for applying energy management concepts U.S. Pat. No. 4,450,820 (issued 29 May 1984) to U.S. Pat. No. 4,979,917 (issued 25 Dec. 1990). U.S. Pat. No. 4,979,917 in tern is a continuing work from U.S. Pat. No. 4,611,999 (issued 16 Sep. 1986). Further, the aforementioned is a continuation-in-part of a related U.S. Pat. No. 4,552,537 (issued 12 Nov. 1985), which again rises from an earlier Haynes U.S. Pat. No. 4,239,013 (issued 19 Dec. 1980). The electro-mechanical instrumentation means of U.S. Pat. No. 4,450,820 and the heat exchanger means U.S. Pat. No. 4,239,013 (issued 19 Dec. 1980) is attached hereto by reference.

The propensity of a moving fluid to follow a curved surface is well known in the art, and its effects explored in such apparatus as stream tubes, lifting bodies (wings), etc. In the marine art, a thrust generating output thrust stream is generally discharge underwater in displacement type vessels. This is done by a water moving apparatus, such as a propeller or impeller, and it may be open to the water, or confined in a specially shaped section (such as a KORT nozzle), or housed in a tunnel or tube mounted in a vessel (such as in a "tunnel" drive, tunnel thruster or axial flow pump), or mounted in a specially shaped cavity with flow straightening vanes (such as a water jet pump). The discharge of water away from the vessel in the general proximity ahead or forward of the transom or shaped section end will cause, depending on the fineness of the vessel stern section and the water velocity, the ejected fluid against-the-hull to follow the curvature of the hull or the hull plate ("Coanda Effect"). The disruption of this straight flow ejection pattern or deflection of the jet stream path from its normal course requires work, this being taken from the vessel. Examples of this in a displacement vessel is the "squatting" in the stern caused by the propellers low pressure field adjacent to the stern, as well as the "hole in the water" the stern tries to fall into resulting from the vessels forward speed.

In the art, this "thrust relation" with the vessel exists roughly stated as:

For jet drive systems discharging into the atmosphere $$[2(P\times A)]\times En=\text{Thrust}$$

Where:

P=Water pressure, PSIG, measured at nozzle

A=Area of the nozzle in square inches

En=Efficiency relation or constant for nozzle and piping system

Thrust=Thrust delivered in pounds

For free stream operating propeller drive systems $$(1-Dt)[\text{COS}\ \theta s(\{\phi Ap/2\}(Ve^2-Va^2)]$$

Where:

Ap=Propeller disc area (Pi/4)$D^2$ FT.$^2$ or $M^2$ (The above values can be found in U.S. Pat. No. 4,611,999.)

B=Breadth of hull relative to shaft output centerline and mean plate line at midsection, in feet.

Dt=Taylor thrust deduction value based on block coefficient and may be calculated:

$$\text{Block Coef.} = Cb = \frac{\text{Immersed Volume}}{L\times B\times Dv}$$

Dv=Mean draft of hull relative to shaft or jet output centerline and mean plate line at midship section, in ft.

L=Length between hull perpendiculars, in ft., relative to propeller shaft or jet output centerline.

Va=Propeller water Velocity of advance in ft./sec.

Ve=Propeller water Velocity of exit in ft./sec.

θs=Propeller shaft centerline angle relative to vessel water line.

ϕ=Mass density constant for water (1.94 for fresh water, 1.99 for salt water for British units; for metric units, use 102 for fresh water and 104 for salt water).

It is apparent that the free propeller thrust is radically affected by the Taylor correction factor, which can have values in the range of approximately 15% to 40%. In submerged discharging jets, the Taylor correction factor can show a loss of up to 50% of that which may be measured with the same jet pump discharging to atmosphere. Open wheel propellers can loose up to over 35% as compared to "free stream" (open flow) measurements. The invention disclosed aids in reducing these ("Eductor" and Coanda Effect) losses, as well as potentially reducing the hulls free resistance (tow rope thrust) to achieve speed.

In W. Stockman (Deutsches Patentamt Offenlegungsschift 2,323,029; 8 May 1973) an appendaged jet nozzling system is described which extends outside the vessel hull and the nozzle interior sheaths the jet stream with air for mixing at the air tube outlet. C. B. Cox (U.S. Pat. No. 3,288,100; filed 26 Jun. 1964) describes an appendage jet nozzling system which extends away from the hull and gases are mixed with the water inside the nozzle system utilizing a specially designed venturi nozzle containing a turbulation blade. In P. B. Rouland (U.S. Pat. No. 3,272,333; filed 20 Sep. 1966) a special venturi nozzling system is described which is transom mounted and wherein the nozzling system is designed to mix the gases with the water within the nozzling system before the mixture leaves the discharge nozzle. W. R. Christensen (U.S. Pat. No. 3,188,997; filed 27 Nov. 1963) describes an appendage mounted water jet thrusting unit which is mounted away from the hull and which passes the jets water into a venturi system whereon it receives pressurized gas and is mixed with the water before discharging. C. M. Paxton (U.S. Pat. No. 1,662,206; filed 7 Apr. 1923) describes a flat nozzled water jet thrusting system used for modifying the vessels wake characteristics ("water excavating"). No gas jacketing or mixing is used.

In the marine vessel art, I. L. Anderson (U.S. Pat. No. 4,458,622; filed 2 Mar. 1982) shows a displacement vessel craft with extendable solid surfaces near the transom for the purpose of altering hull shape (with the engine driving means located ahead of these) to translate from displacement to a planing type hull. In the art, "squat board", transom mounted after planes, and trim tabs are also known as means to affect vessel trim in relation to the driving source. However, these are comprise appendage or hull structures. There goal differs from the inventor. The inventors subject invention is intended to break the couple between a moving fluid and a plate surface with a second (lower viscosity) medium). further, it is intended to alter the load bearing properties of the hull (from buoyant surface to planing surface); further, it is intended to create load bearing points of concentration whose properties are changeable.

None of the prior art deals directly with reduction of Coanda Effect losses. Thrust losses are treated by mounting their thrust applying system on an appendage (at the expense of adding parasitic drag) well away from the hull or discharge through the transom. None of the prior art deals with separating boundary layer water flow from the hull in a tuneable relation with vessel speed and the current demands of the operator.

None of the prior art deals with door closure and/or check valve logic to control the direction, the magnitude, and the translation of thrust and drag vectors.

All the aformentioned either ignore vessel boundary layer "Coanda Effect" problems and pass a fluid stream over the hull shape (in the Anderson case, modifying the hull shape for a planing surface without consideration to the extendable bodies creation of suctional drag), or have as a focus the homogenous mixing of water and air to create their propulsive fluid, and this at the expense of system energy. Also, the homogenous air/water mixture is subject to the same Coanda Effect and Taylor Wake phenomenon as unmixed water, although some benefit may be gained due to the ejected fluids change in density and easier expandability.

An indicator as to the viscous drag exerted on the jet discharge of the prior art is the "Divergent Plume" (see Rouland) of the fluid upon exiting the vessel. The Haynes invention subject jet discharge leaves the hull with the jet stream highly columnated and, over some distance away from the hull, the gaseous layer surrounding the jet stream breaks down in three distinctly observable stages, wherein the final stage results in jet stream gaseous layer break-down, jet stream homogenous mixing, and the development of a "divergent plume". This final stage must happen outside and away from the hull influence, and must be shielded away from the hull. Similarly, as the vessel gains sufficient speed and the water sheet flow across the door reaches sufficient speed, the Haynes "anti-Coanda effect" cavity can have its door deployed. A sufficient pressure drop must exist across this opening to draw an extended gaseous boundary layer along the hull, thereby causing anti-Coanda separation of the principle sheet flow field away from the hull. The reduction in hull drag in the affected region behind the door must be greater than the drag caused by the door deployment and the energy lost in passing gases into the anti-Coanda effect cavity (in order to effect energy savings). The reverse is true to effect hydrodynamic braking (e.g., at planing speeds the doors are retracted, and Coanda effect braking will occur).

The gaseous layer against-the-hull also serves to modify the vessels wave making properties, e.g., aid in relieving the suction caused by the after body of the vessel moving through the water (which none of the prior art accomplishes), and thus lowers the thrust required to propel the vessel at speed in quiet water (conversely, door deployment at speed without developing the gaseous layer can develop increased drag). The subject inventions jacketing gaseous boundary layer quiets the jet discharge noise, and acoustically insulates (quiets) the sound transmission of the affected area of the hull from radiating propulsive noise (substantial reduction in noise transmission). The subject invention, in supplying a jacketing gaseous boundary layer rising against-the-hull, also provides an insufflare barrier which cushions the impact of floating and suspended debris. None of the art of reference meets the objects and advantages of the subject inventive drive.

In the subject invention, the integrity, rather than the mixing of, the water jet stream is of primary importance. Further, this boundary layer must be specially tuned if its properties are to be explored.

The heretofore described system expressed as an auxiliary drive and hull resistance controlling means consists of an engine or motor 10, a forward thrust output portion 12, a reverse thrust output portion 14, a thrust direction selector valve 16 and a jet pump 18. Engine or motor 10 is connected to jet pump 18 fluid is kineticly converted therein by impeller blade lift and (depending on the pump) centrifugal force, through a coupling 20 driving into impeller shaft 22. Engine 10 is mounted on the pump 18, in the preferred embodiment, by flexible motor mounts 24. Pump 18 consists of a water intake region 26 directed into or toward the impeller 28. Impeller 28 accelerates the intake water 30 through the pump casing 32 and into the pump water discharge passageway 34. Water 30 is accelerated and a pre-rotational or rotating moment introduced in the water picked up into the impeller eye, in another embodiment (not shown) by water pre wirling vanes in the pump intake, and after passing through the impeller, the rotated flow is straightened by a system of stator guiding vanes 35 placed at the exiting portion of the pump. These vanes also aid in heat dissipation from the heat exchanger, as later elaborated on.

Pump forms, such as (but not limited to) a propeller, axial flow pumps, mixed flow pumps, centrifugal pumps, as single or multiple stages, and Magnetohydrodynamic Drive pumps (MHD) may be incorporated into the invention without departing from the spirit and intent of the invention. It is understood that the structure of the described invention can be altered to meet the specific compromises inherent in the design of a functional apparatus, and in the creation of an integrated vessel system as a platform satisfying a specific need.

Figures 1, 2:
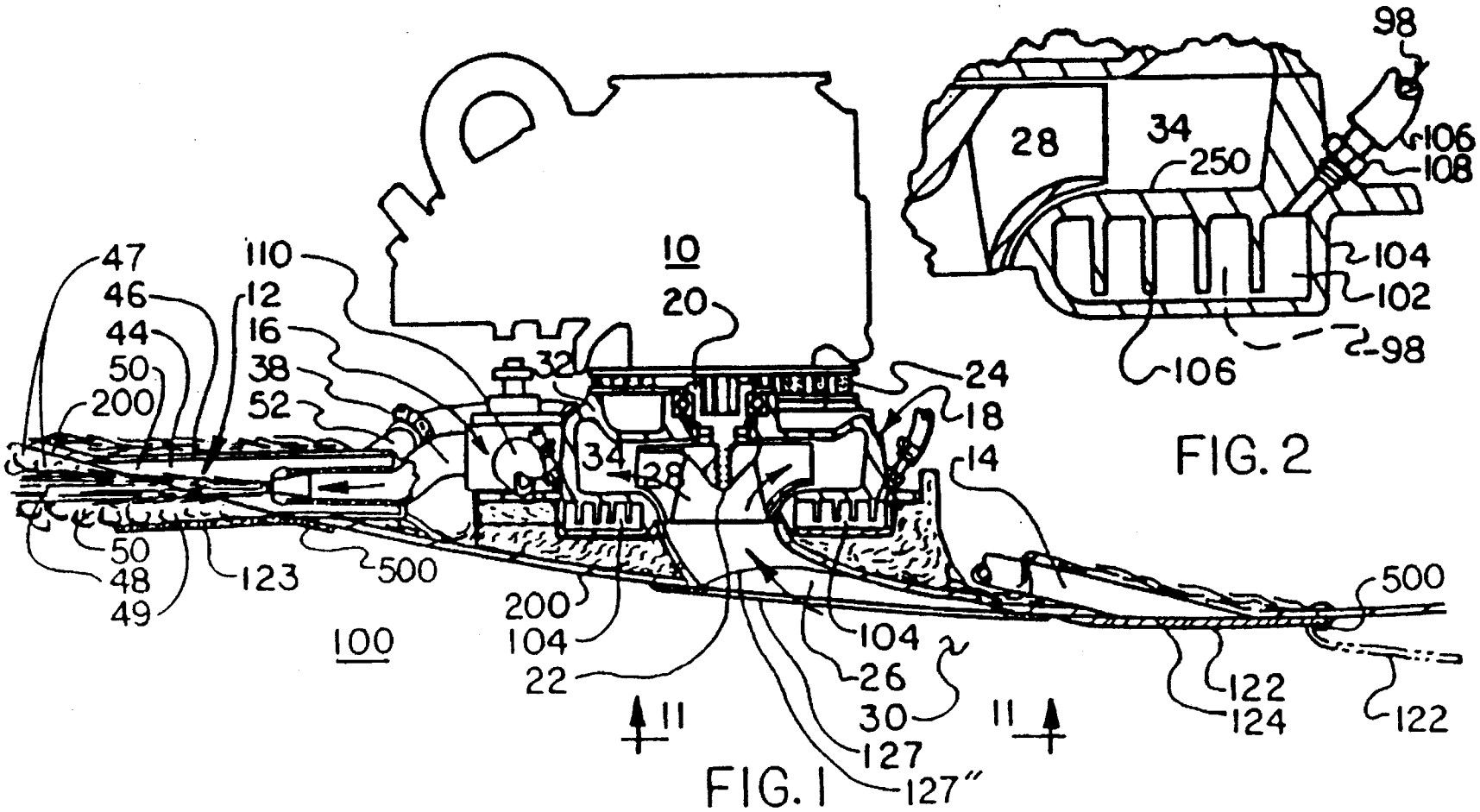

The water expressed out of pump 18 through passageway 34 is directed under pressure by a connecting means 36 or passageway 36 to thrust directional control valve 16. In the forward thrust direction mode, water at high velocity is ejected out of valve 16 into thrust tube 38. Thrust tube 38 terminates in a conically tapered nozzle 40 directed away from the vessel propulsion direction. Tapered nozzle 40 has a backward radiused or sharp upper surface 42 to form a divergent annular passage to allow the gases 50 in the jacketing region 44 of tube 46 to cleanly accelerate and surround ejected expressed thrust stream 48 with a boundary layer of such gases extending externally of the hull as shown in FIG. 1. Gases 50 are directed into jacket 44 by exhaust tube 52 from engine or motor 10 to a pressure, in one example, of 3 atmospheres nominal (and beyond) the ambient pressure of the water at the nozzle region (supplied from a compressed gas, engine exhaust gas or similar pressure source). Gases may be supplied from ambient air, with the energy required to establish the boundary layer being supplied by the jet stream in the nozzle region (at some thrust loss), wherein this is the usual installation case. In the case of a multiple chambered Corona-Jet, jacket 44 is partitioned or baffled, and the partitions (preferably) are joined together above the at rest water line (see FIGS. 20, 21, 22, and 23). As the jet stream 48 is discharged into the water surrounding the vessel 100, it is commonly found in the art that a suction is created against the hull. This hull bottom 200 suction due to the "Coanda Effect" is relieved by a blanketing gaseous barrier layer 47 over bottom 200. The low viscosity and easily expanded boundary layer of air and/or exhaust barrier gases 47 is directed by jacket 44 and flap or door 123. The jet stream 48 is coated by the surrounding or blanketing air and/or gas covering 49, which progressively breaks down, for at least a short distance from boat bottom 200. The hull suction is relieved by the low viscosity and easily expanded gaseous layer directed by jacket 44. Flap or door 123 can act to cause hydraulic lift (act as vessel trim tab, by an activator means such as a linkage with hydraulic cylinder, or electric linear activator, or stepping motor, etc.; wherein also feedback as to position is provided by an encoder, or resistance feedback potentiometer, etc.; to a read-out and interpretation system), and enhance the against-the-hull boundary layer 47. As speed increases, and with a segmented gas jacketing region 44, separation of the affected downstream portion of the hull from ocean 100 can be achieved (this to include, with an extended progressively openable gas jacket by tunable door means, the entire after body of the vessel or hull). Optimum door positioning and gaseous layer pressure may be determined through appropriate placement of propulsion system energy and speed determining means, such as what is described in U.S. Pat. No. 4,450,820 (titled "Engine Fuel Conditioner and Monitor"), and through appropriate instrumentation output ratio analysis, desired parameters achieved.

Figure 7:
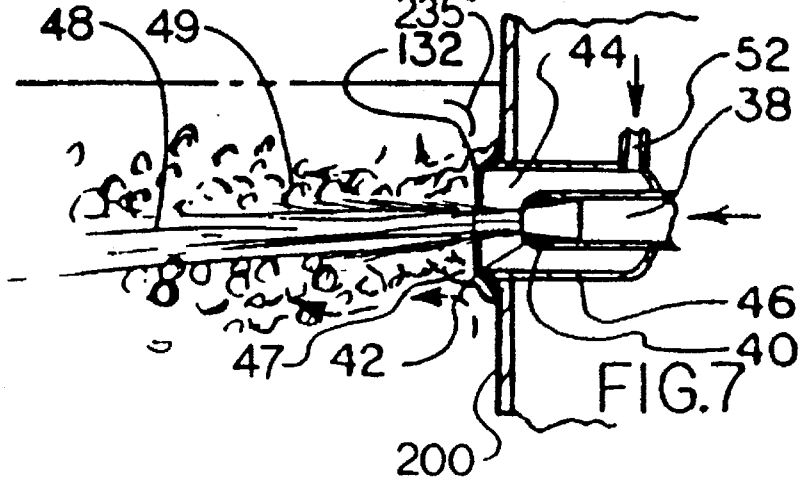
FIG. 7 is a cross-section of the preferred output nozzle system for submerged discharging water jet type bow thruster systems, this utilizing a gas source to develop a hull isolating surrounding gaseous fluid for the jet output thrusting stream as the subject invention.

Preferably (see FIG. 3) the shortest length jacketing region 44 should be behind the end of most rearward extent of surface 42 is dead flush or no (0) nozzle inside diameter 60, with the maximum recommended length no more than five (5) nozzle diameters 60, with one (1) to three (3) yielding good results. The jacket 44 inside diameter should have a minimum of one and one half (1.5) times the nozzle 60 cross sectional area, but should not be any greater than six (6.0) times the output nozzle 60 cross-sectional area. Generally, area ratios within 2.0 to 3.5 yield good results. It is recommended that the entrance tube for gas flow introduction should be no less than one (1) diameter 60 from the end plane established by nozzle 40 end, although the tube can be located closer with useable results. The ratios are "tuned" and in proper relationship when the gas barriers 47 and 49 are adequately supplied with gases, as is shown in FIGS. 1 and 7, and the vessel speed is optimized. In an anti-Coanda cavity which is extended across the vessel bottom, the gas cavity for the water jet should incorporate the above recommendations, and the gas cavities to separate the hull boundary layer should be separated chambers with individually adjustable doors. This is to limit the backward circulation of the water, deeper along the hull, into the anti-Coanda cavity and moving upwardly in the cavity into a region (along the hull) of lower pressure. Thereby, as the vessel gains speed under the jet power (with gaseous boundary layer properly tuned), the doors closest to the water line can be opened first, and the boundary layer separation established progressively deeper as the vessel gains speed (thereby reducing the power needed to achieve hull after body transition point "planing" power). This can be an automated function utilizing speed and power instrumentation (and appropriate door position mapping located in Read Only Memory or ROM). The doors can also be controlled by a computer based system utilizing a feedback loop (to hunt for parameter optimization and sensor error checking), which may be an expansion of the device disclosed in U.S. Pat. No. 4,450,820. The simplest system would be a "programmable controller" with feedback loop programming (combined with instrumentation interface cards and sensors), wherein door positions would be predetermined through sea trials (under variables such as different load conditions, speed, sea state, and equipment percentage availability scenarios).

The pump 18 is heated by motor or engine 10, and thereby acts as an engine or motor heat exchanger. The pump 18 is heated by liquid (such as gases or liquid, e.g., exhaust gases, water, alcohol, oil or other liquid material) at a temperature above the water temperature of water 100, this heated flowing liquid material being injected into a finned and labyrinthine passageway 102 in sealed chambers 104. Water 100 may also be at a temperature below the water being pumped for propulsion (the energy thus gained being used as a thermal source for a heat pump device). Hose 106 passes the heated engine water 98 through fitting 108 into passageway 102. The heated water 98 passes under and, as application permits around and over the pump and through fins 106. The casing walls conduct heat into the surface lining the interior of the marine jet pump. The engine cooling water (or heating fluid in the case of a heat pump reservoir application) 98 leaves passageway 102 through line 110 whereon water 98 is returned via convection or coolant pump to cool engine 10 (or heat subject apparatus in the case of a heat pump application).

When valve 16 is put in the thrust reverse mode, water 30 is passed into reverse tube 120 whereon the fluid is routed ahead of the pump intake and discharged as a thrust stream 48 through an opening in the hull. The openings in the hull for the jet can have sea closure doors opened and closed by known mechanical means. Note: the sea closure doors may be confined by keels or have walled portions or sides on them, thereby creating or forming a retractable or area adjustable portion of the gas jacketing region 44. The unit can be used in conjunction with an automated controlling device, such as a computerized control, wherein a specific power-up and power-down sequence can be followed in response to sensor information. If the thrust reverser door is left closed (secured by the hydraulic cylinder, electric actuator, or similar means) the reverser fluid will back up the Corona Jet air intake passageway and can be, with the duct properly check valved to deliver the fluid in the desired direction, passed to other applications, such as bow and/or stern thruster ports.

Figure 10:
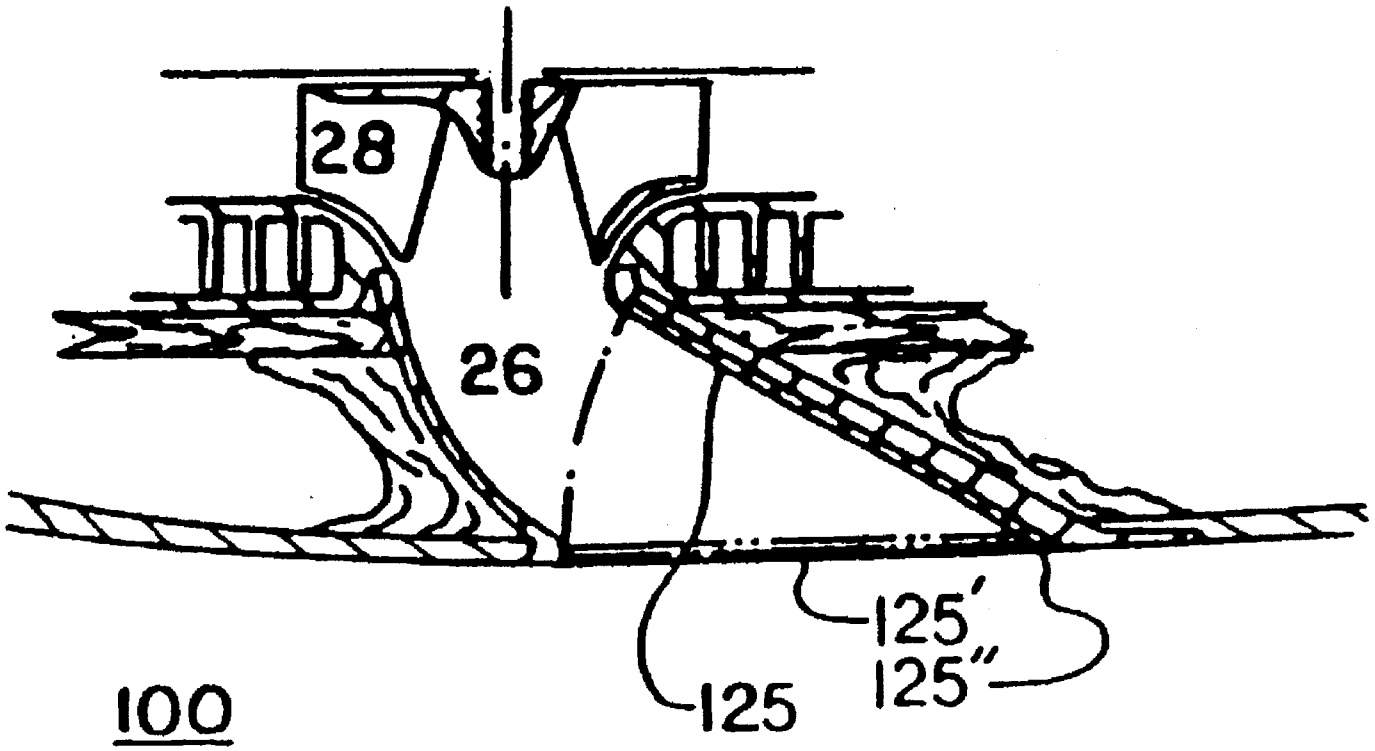
FIG. 10 is an alternative pump intake configuration employing a butterfly valve opened by pump intake pressure or other means; and may operate in cooperation with the jet discharge doors.
Figure 11:
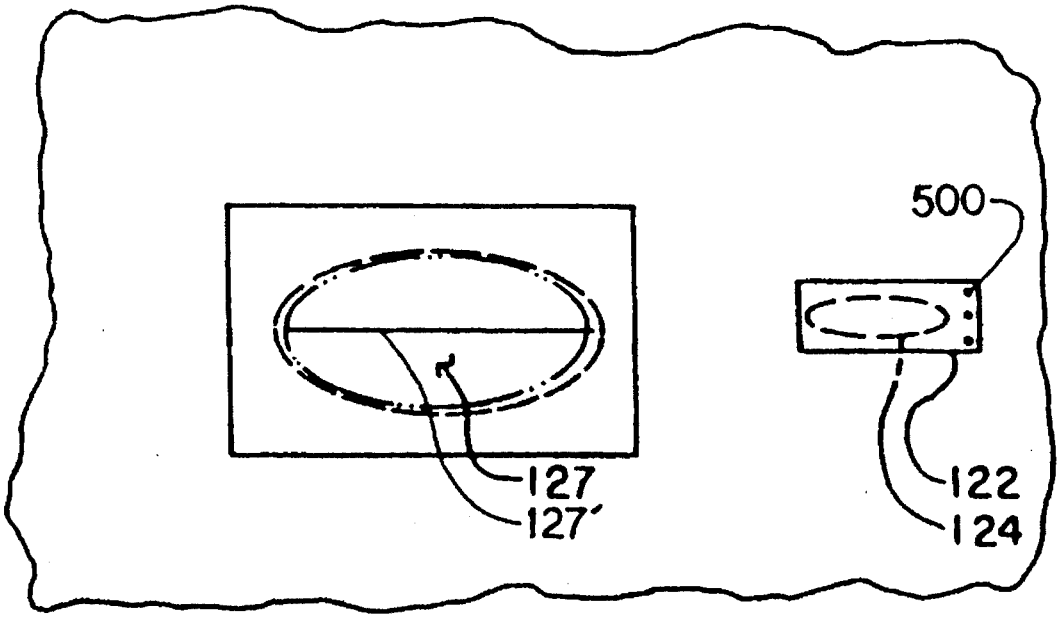
FIG. 11 is a bottom view of the pump intake of FIG. 1 incorporating a thin rubber closure and shown in the engine off (closed) position.

In some applications, a thin flexible material, such as a rubber of low durometer and with a specific gravity less than 1 (allowing it to "float" closed when the jet system is not in operation), flap 122 is placed over the reverser tube to streamline reverser thrust output port 124 when not in use (this may be used in place of a door system). A flap 123 over the forward thrust port made by tube 12 may be similarly provided for with equal streamlining and marine biostatic (for marine growth inhibiting) results. When reverse thrust is in use, door or flap 122 is opened or blown open by the thrust stream and caused to rotate about an attachment by fastening means point 500 and reverse thrust is created. When the boat moves forward, door or flap 122 is closed or caused by water flow about the hull to close flush when the jet water flow is off through this port. When forward thrust is in use, door or flap 123 is opened to its appropriate position, or (design dependant) blown open and forward thrust is created. In FIG. 10, a flush closing intake valve 125 is provided such that when the propulsion jet is turned off and therefor no longer drawing intake water into the pump, the pump intake 26 is closed off by valve gate 125, rotating from position 125 to 125' about a fastening point or hinge point 125". This reduces the boat or vessel hull drag when under sail (sailboat case) or when steaming under propeller drive (when system is used as a thrust augmentation system), and also prohibits the intrusion of debris and marine growth into the dormant jet system. A butterfly valve is preferred, although a slitted (along a longitudinal line parallel with the direction of vessel travel) flexible thin rubber closure 127 fixed all around the edges (see FIG. 11 and FIG. 1 and the drawn outline of slit 127') to the boat bottom (and opened by pump intake suction) may be used. Other known flush closing valves, such as sliding or gate valves, may also be used. NOTE: If thrust loss is critical in the reverse direction, a nozzle similar to nozzle 12 may be incorporated in the design.

Figure 3:
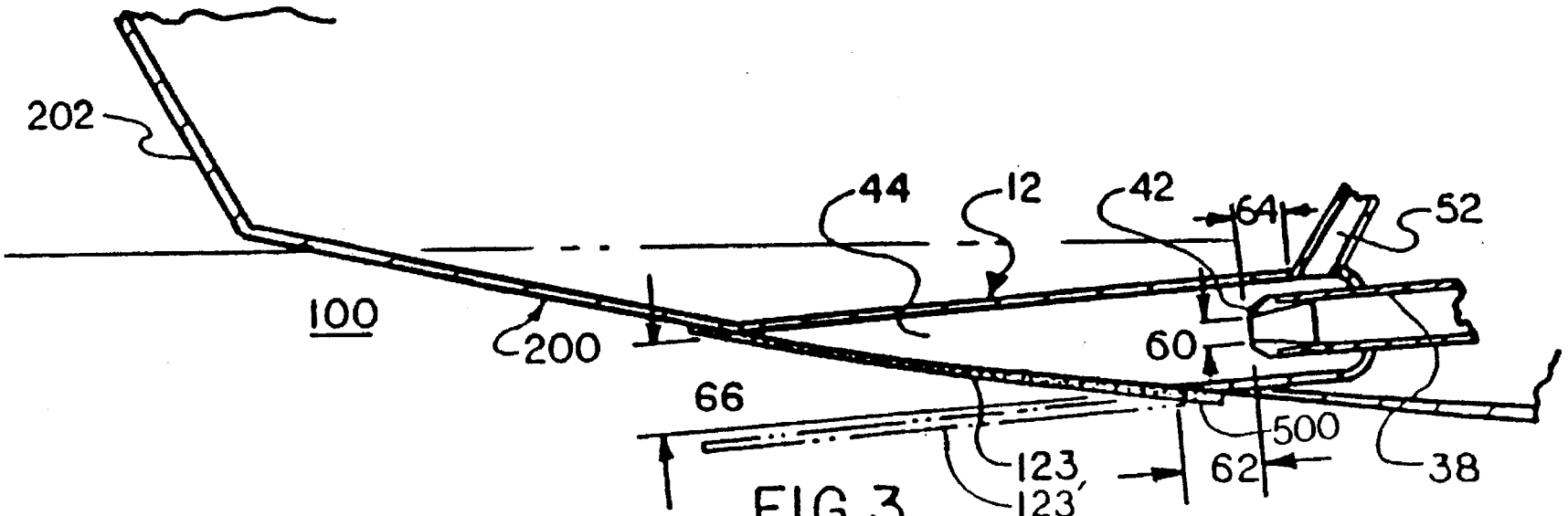
Figure 5:
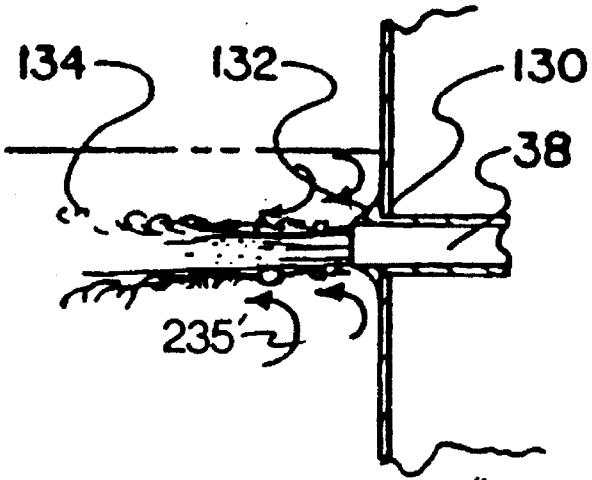
FIG. 5 is a cross-section of an output jet nozzle of a bow thruster with an extended lip to aid the output flow of the jet in passing into a cavitating flow and in extending the jet stream originating point away from the hull surface.
Figure 4:
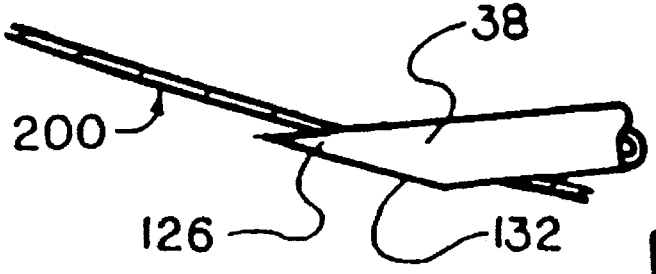
FIG. 4 is an output jet nozzle of an auxiliary drive penetrating through the boat hull and exhibiting an extended edge to aid in cavitating the jet flow and extend the jet stream originating point away from the hull surface.
Figure 6:
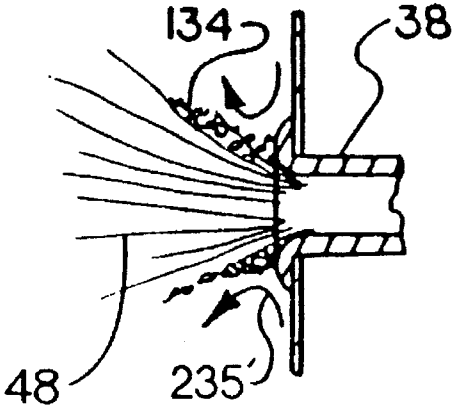
FIG. 6 is a cross-section of a bow thruster nozzle with arrows indicating the direction of fluid flow of the jet stream as it drags water along its trail of discharge and the thrust lines are dispersed.

In FIG. 4 a super cavitating nozzle not utilizing a gas jacket around the thrust output stream 48 is shown. A lip 126 is extended beyond boat hull bottom 200 by about 20% to 100% to tube 38's inside diameter. The outside of the tube is preferably radiused with the hull. This allows a turn-around region for vortexing fluid flow and reduces the region subjected to super cavitating shear. A similar nozzle 130 is shown in FIG. 5 as a cross-section, in a bow thruster application. Lines of flow 235' indicate the water 100's vortexing and energy deduction action. A cavitating region 132 draws air out of solution with the water and reduces thrust deduction. However, significant energy must be lost from the jet stream and momentum transfer diffused due to stream expansion 134 (see FIG. 6) and loss of the energy needed to "pull" air out of water solution, to cavitating or boiling water 134 through a sudden pressure drop adjacent to the hull, and to drag water with the jet stream, e.g., pump the adjacent water to the jet stream along with it in vortex shear and suffer the losses associated with momentum transfer in the nozzle region and the negative pressure region created against-the-hull or adjacent to the hull 200. In FIG. 7 a bow thruster jet output nozzle utilizing the same preferred thrust output principles as in FIGS. 1 and 3 is illustrated. However, the thrust deduction factor is significantly reduced (depending on the application, less than 5% loss to a positive improvement depending on the propulsion standard compared to an hull mounting configuration) compared to FIG. 6, due to the attachment of the gaseous layer against-the-hull as shown by lines of low arrows 235" and gas 47, wherein a conventional jet thruster thru-hull submarine discharging (such as in FIG. 6) can loose about 40%–50%. The relative proportions are the same as for the thrust output tube 12. However, a sharp edged lip 132 of a lip depth greater than 10% to 200% of output port diameter can be incorporated to further reduce hull suction in cases where the gas boost available is insufficient to supply the requisite boundary layer necessary to sustain an anti-Coanda boundary layer against-the-hull (besides increasing parasitic drag on the vessel hull, the boundary layer flow of the vessel is not characteristically modified, and the lip extension will result in a net inferiority in objective propulsive properties a subject of the invention over a flush design, e.g., thrust, modification of vessel towed resistance, noise and hull lubrication). The taper within nozzle 40 should be 6 degrees ideally, and not have steps in going to conformity with tube 38 inside diameter to nozzle orifice diameter 60. It should be understood that other nozzle configurations may be used, such as oval and rectangular, to meet specific vessel requirements, without departing from the spirit and intent of the described invention.

Figure 8:
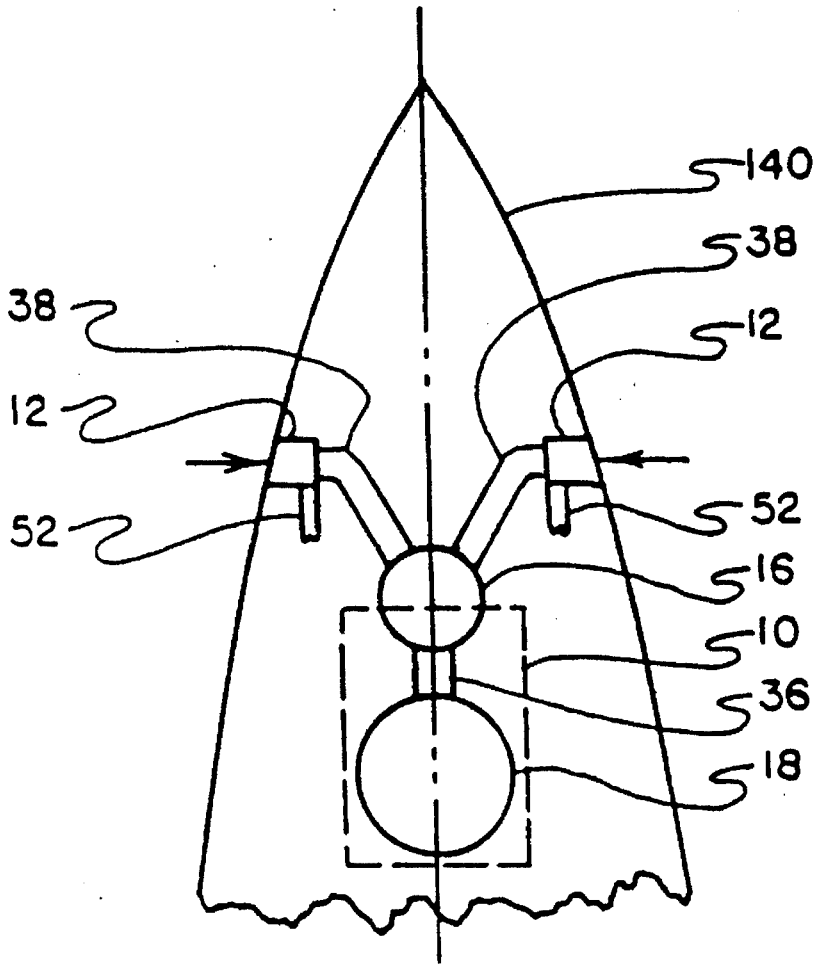
FIG. 8 is a plan view of the mechanical-hydraulic layout of the bow thruster application of the propulsive apparatus.

In FIG. 8, a preffered plan-view relationship is shown wherein the subject invention is supplying side thrust to maneuver a bow 140 of a vessel of ship (arrows show thrust direct). Valve 16 is then "Y" shaped and selects between port and starboard thrust. Air is injected at lines 52.

Figure 9:
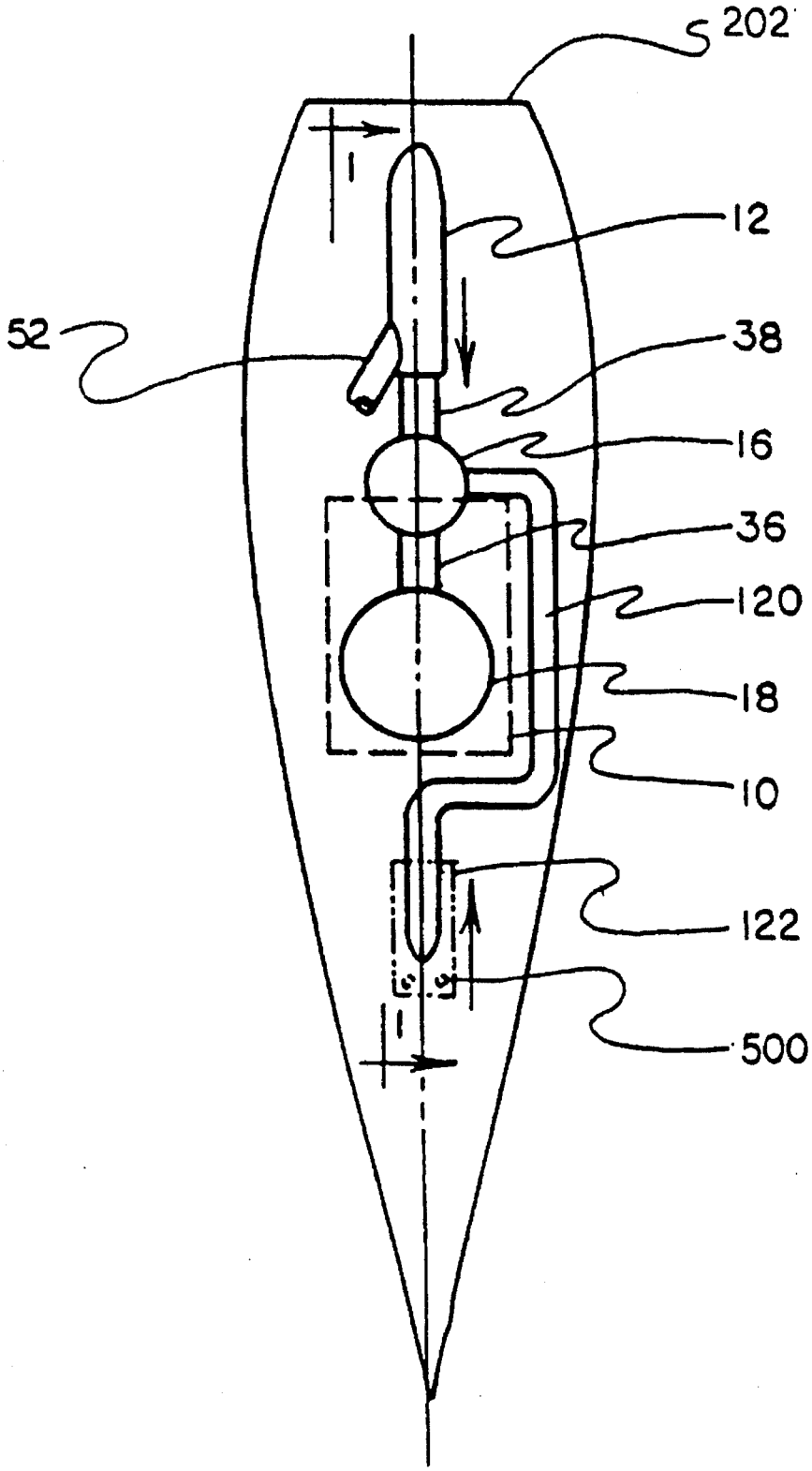
FIG. 9 is a plan view of the mechanical-hydraulic layout of the jet auxiliary drive for marine use.

FIG. 9 shows a preffered plan-view relationship for the invention used as a marine auxiliary. Steerage as a marine auxiliary is provided by a steering rudder located aft of the jet output, preferably greater than 30 inches. In neutral, the thrust valve 16 directs water flow equally out both thrust ports, and proportionately divides thrust as it is moved from 100% forward (or port in the case of a bow thruster) to 100% aft (or starboard in the thruster case). Ideally, the rudder is located outside the jet auxiliary jet stream. In a catamaran sailboat, the rudder may be to the inboard of the hulls, thereby steerage of the rudder can be designed such that one rudder will pick up the edge of the jet flow field for enhanced steerage. It has also been found that an inverted "T" section of "I" section rudder works well, as the top and bottom acts to enhance the capturing and transfering the jet field flow momentum, and the bottom "foil" shape can be designed to support hull weight (as a hydrofoil) with increase in vessel speed.

Figure 12:
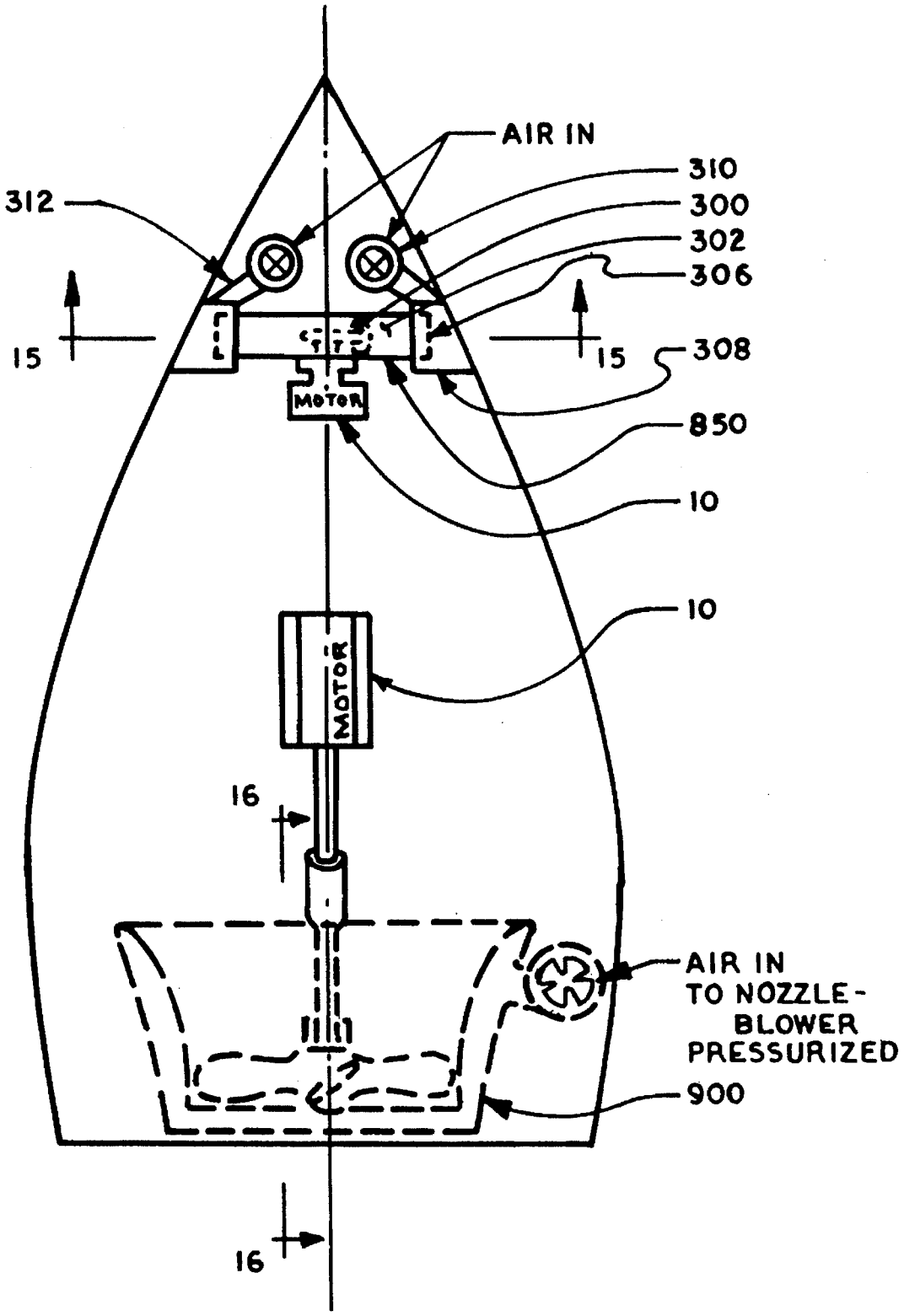
FIG. 12 is a sectional plan view of a vessel with a tube mounted propeller thruster used in a bow thruster application and a housed or nozzled propeller as a thrust jet stream driving means.

In FIG. 12 is shown a plan view in partial cross-section of a vessel (see also FIGS. 15, 16, 22, 23, 27 and 28). A propeller means 300 (or 28) is shown rotating in a conduit or alley 302 (or 902) and filled with the water to be used as a propulsive fluid. This water is driven by the propeller through a nozzling exit point 306 (see also FIG. 15) into a boundary layer generating region 308. An air layer is defined about the outputted jet stream to define a boundary layer which acts to provide a layer of transitional shear as the water leaves the vessel. This air layer can be provided by a charging blower or compressor 310 (especially applicable in a propeller system because of the large volume of air required and the relatively low ejected stream velocity) through a duct 312. These numbers may be used in FIGS. 13, 14, 15 16, 22, 23 and 27 to 31 to explain the inventions applications and components. Gas cavity cavity passageways can be connected above the waterline. The invention supplies a necessary layer of gaseous fluid against-the-hull 900, which works to lower Coanda Effect propulsion losses and reduces the vessels water friction and wave making power losses. This blanketing of the ejected thrust stream also provides a region of high transitional shear between the propulsive fluid and the outside water, and increases the amount of time in which the ejected fluid may dissipate its energy. This reduces the shear shock of the ejected jet stream, and significantly reduces propulsion noise. Also, the region blanketed by the against-the-hull gaseous boundary layer is effectively altered in its noise transmissibility characteristics, further changing the noise characteristics of the vessel.

Figure 13:
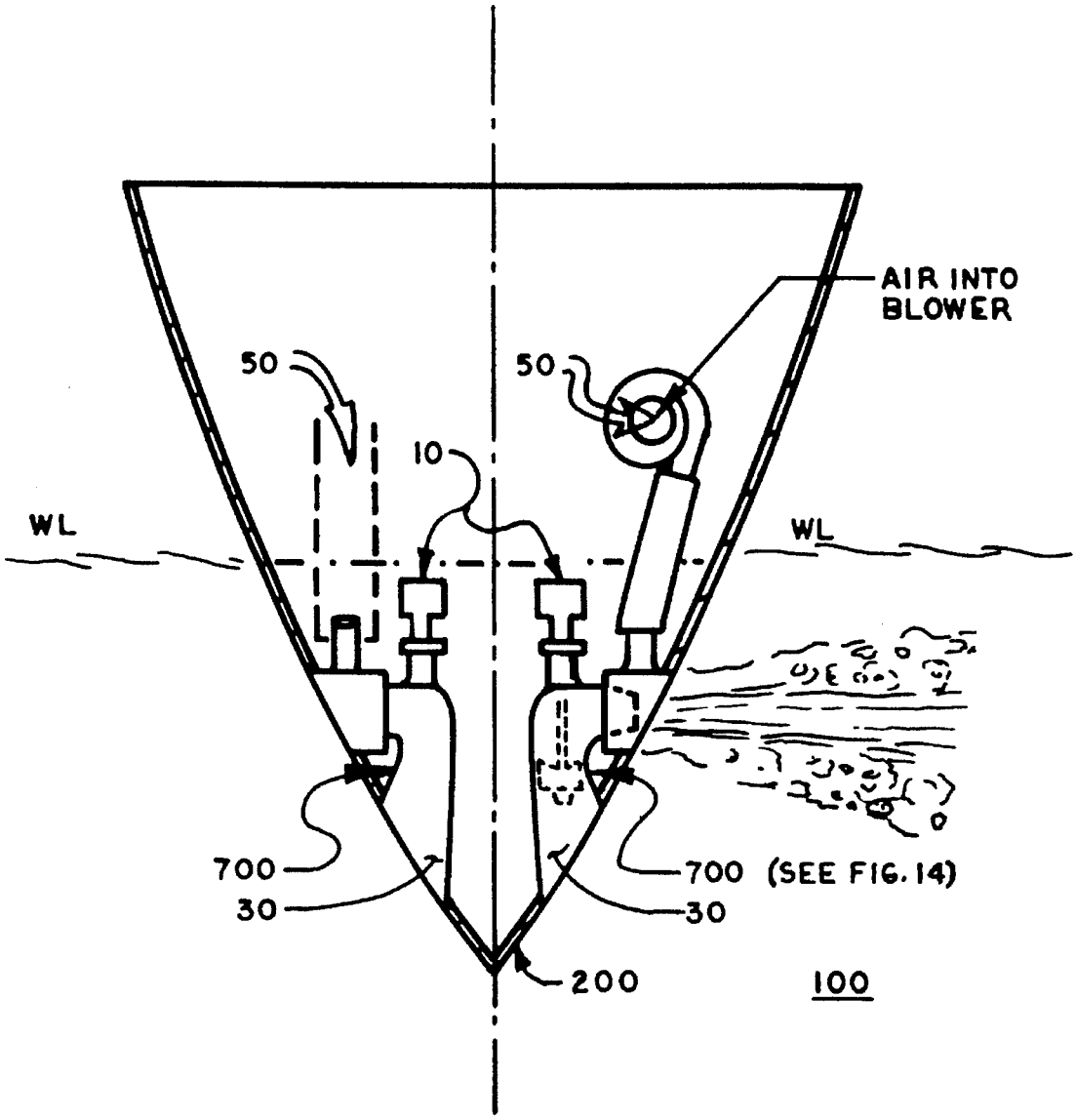
FIG. 13 is a bow view of a vessel with an axial flow thruster module as used to thrust in a single direction outlined.
Figure 14:
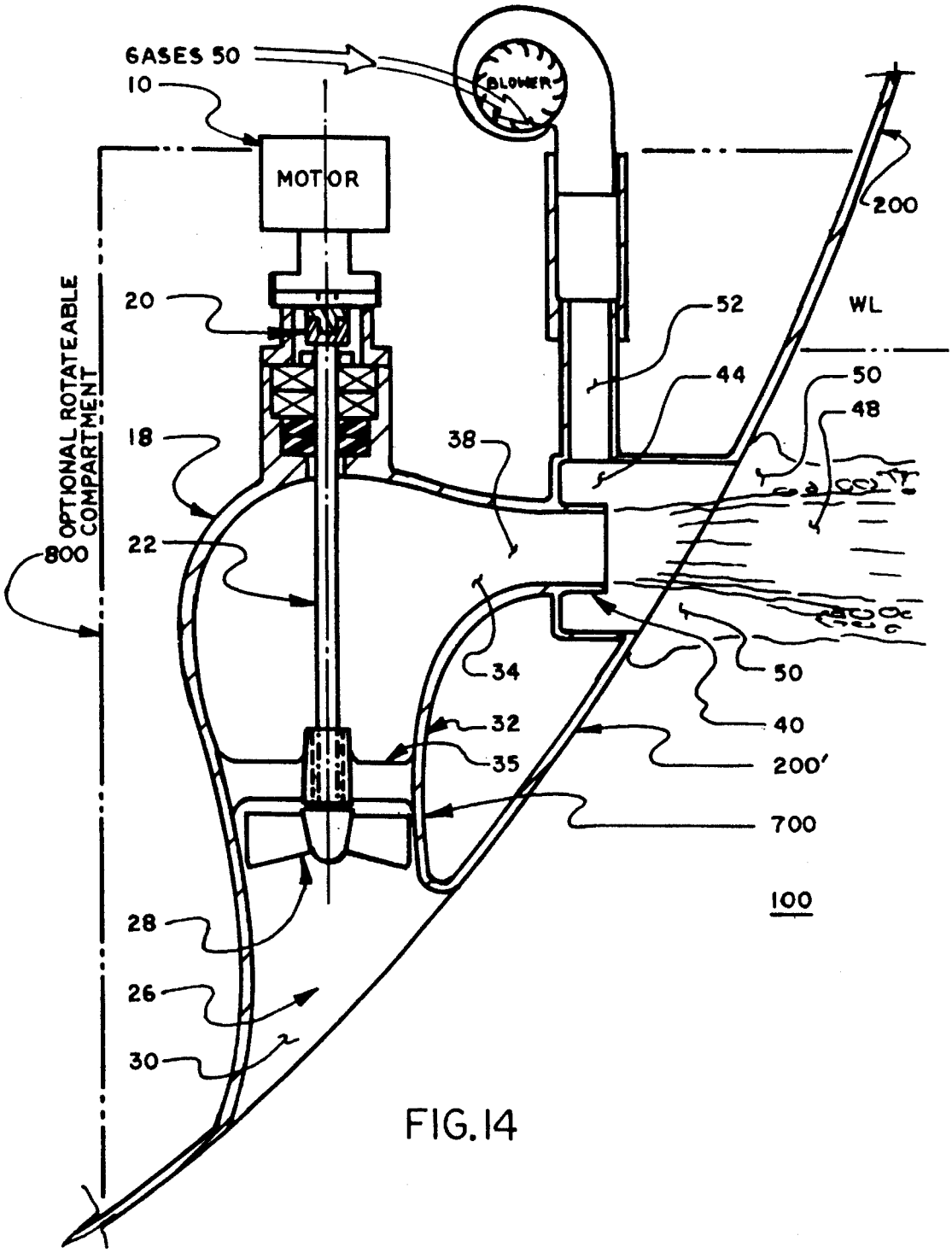
FIG. 14 is a partial cross-section of FIG. 13 taken on line 14 showing the thruster module construction details.
Figure 18A:
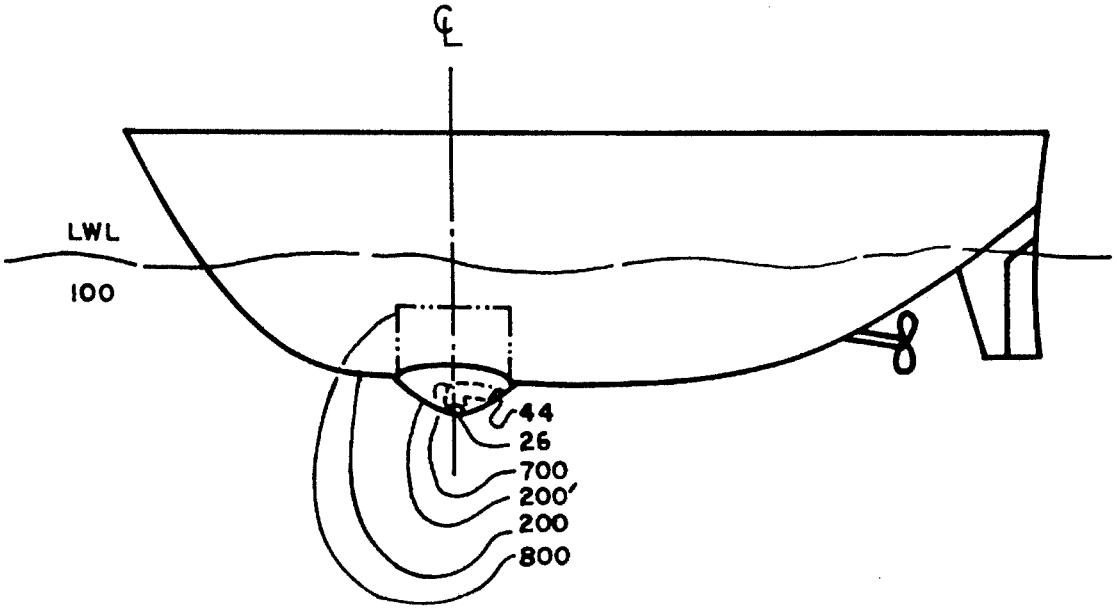
FIGS. 18 and 18A are profile views of a water craft, showing the thruster module of FIG. 14 rotated into two of its many possible positions
Figure 18:
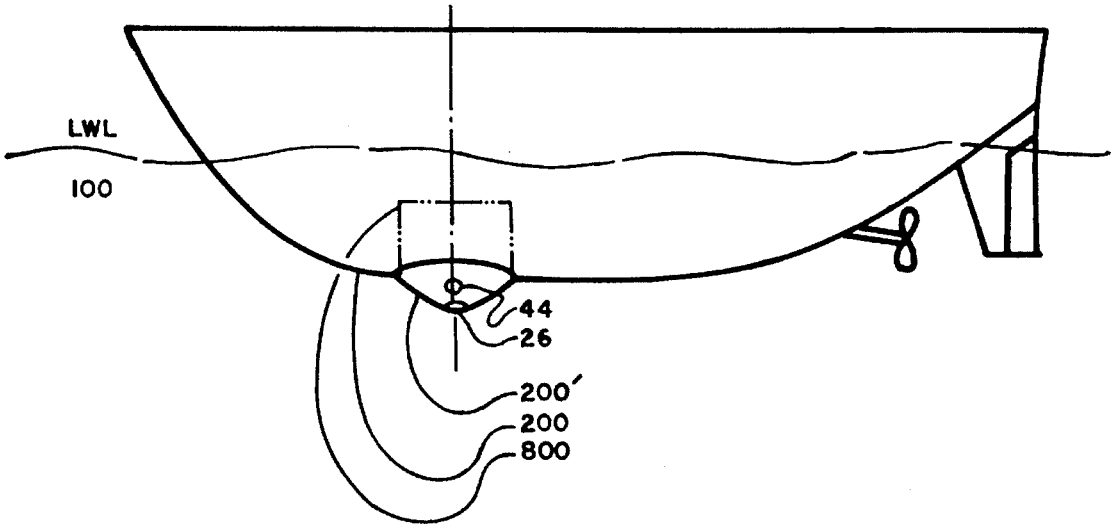

In FIGS. 13 and 14, a single thruster pump 700 is shown as a "module", a single thruster installed to apply thrust in a specific direction. This thruster module 700 may be installed in a rotatable compartment 800, or located on a rotatable hull plate 200' (see FIG. 14 and 18) on the vessel bottom wherein this hull plate 200' is rotated by a motor means, wherein such thruster module may provide thrust selectively through 360 degrees of selection (an "azimuth" thruster). This would allow the jet discharge, through use of the gases 50 (Corona-Jet principle), to be expressed away from the vessel or ships bottom with significantly reduced Coanda Effect and eductor losses. Such an azimuth thruster would usually be located to intake 26 and discharge 44 through the vessels bottom plates 200 and 200' and thereby would be discharging its gas jacketed water jet stream along the vessel bottom and the curved upward chines and vessel sides. Configurations of this type of thruster would include one wherein the intake 26 and discharge 44 would be through the vessels bottom plates 200 and 200'. This thereby would be discharging stationary and a directable flush nozzle would discharge the jet stream (thrust would be poorest when the pump would ingest its own output). Another type would have the jet intake and output rotate as a module 800 (giving maximum thrust at all points of jet discharge). Such is shown in FIG. 18A (position 1, thrusting aft) and FIG. 18 (position 2, thrusting toward port side; reaction to starboard) at two points and then can be rotated toward port) of its possible 360 degree orientation.

Figure 15:
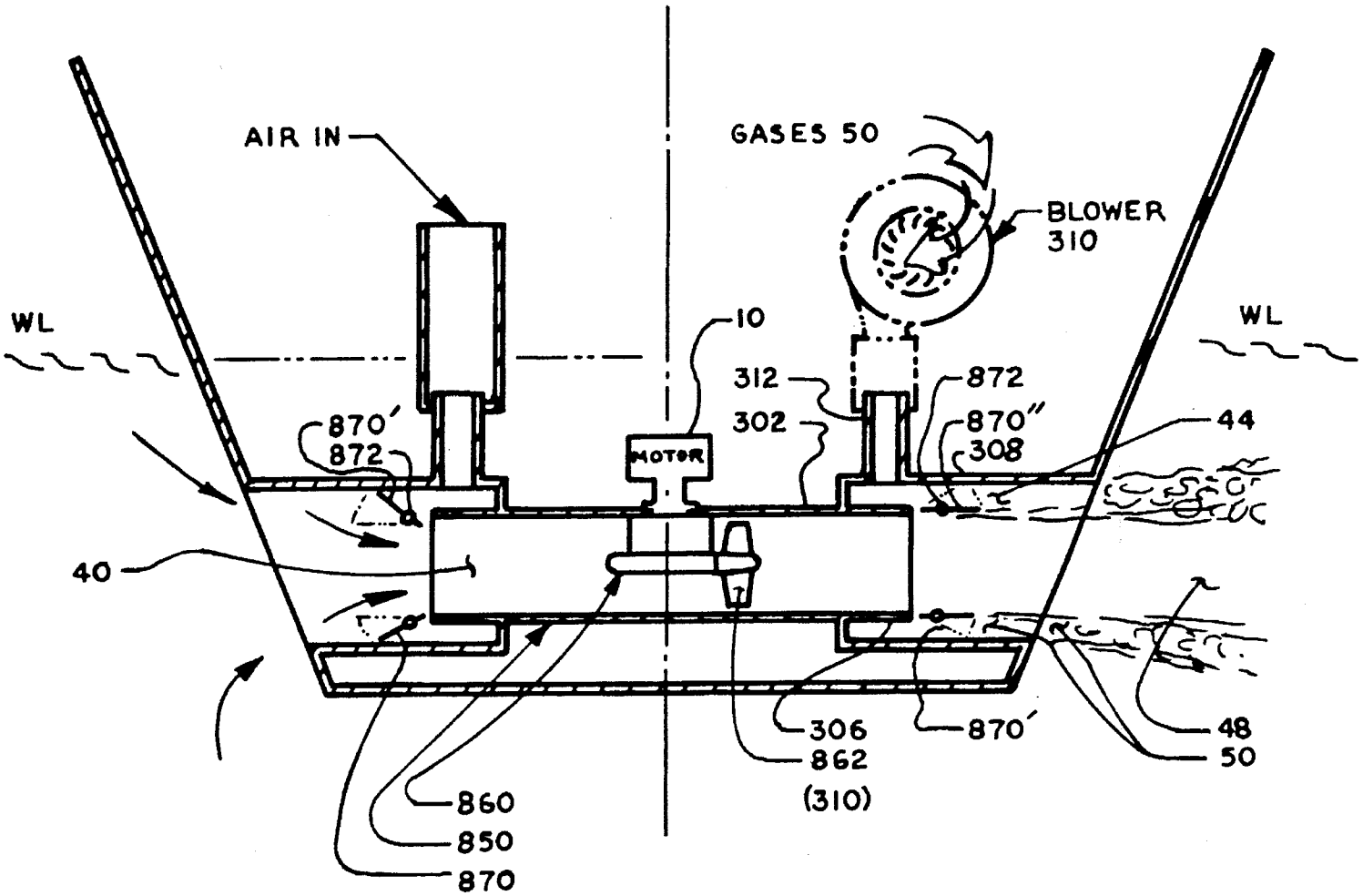
FIG. 15 is a cross-sectional view of a tube mounted propeller thruster taken along line 15—15 of FIG. 12 showing incorporation of the invention.

In FIG. 15 is shown a housed propeller 850 type ("tunnel") bow thruster 850 with gear housing 860 and propeller 862. The water flow may enter or exit through a cylinder 850 or "tunnel" 850. Water flow entering and exiting the thruster is directed by a variable flow directing means or flow plates 870. This allows columnated and directed streamlines of water flow into the propeller and a nozzled flow exiting the propeller. Plates 870 pivot about a pivot point 872. Plates 870 may be moved between positions 870' (intake, wherein the water is smoothly guided from the jacket region 44 to the tube outlet/inlet portion or nozzle portion 40) and 870" (output, wherein the plates open and define a water expressing nozzle and the region where gases 50 will be defined around the water thrust stream) in response to water flow forces by the balance position of the pivot 872. Alternatively, these plates may be controlled by other means, such as electric and hydraulic actuating means.

Figure 16:
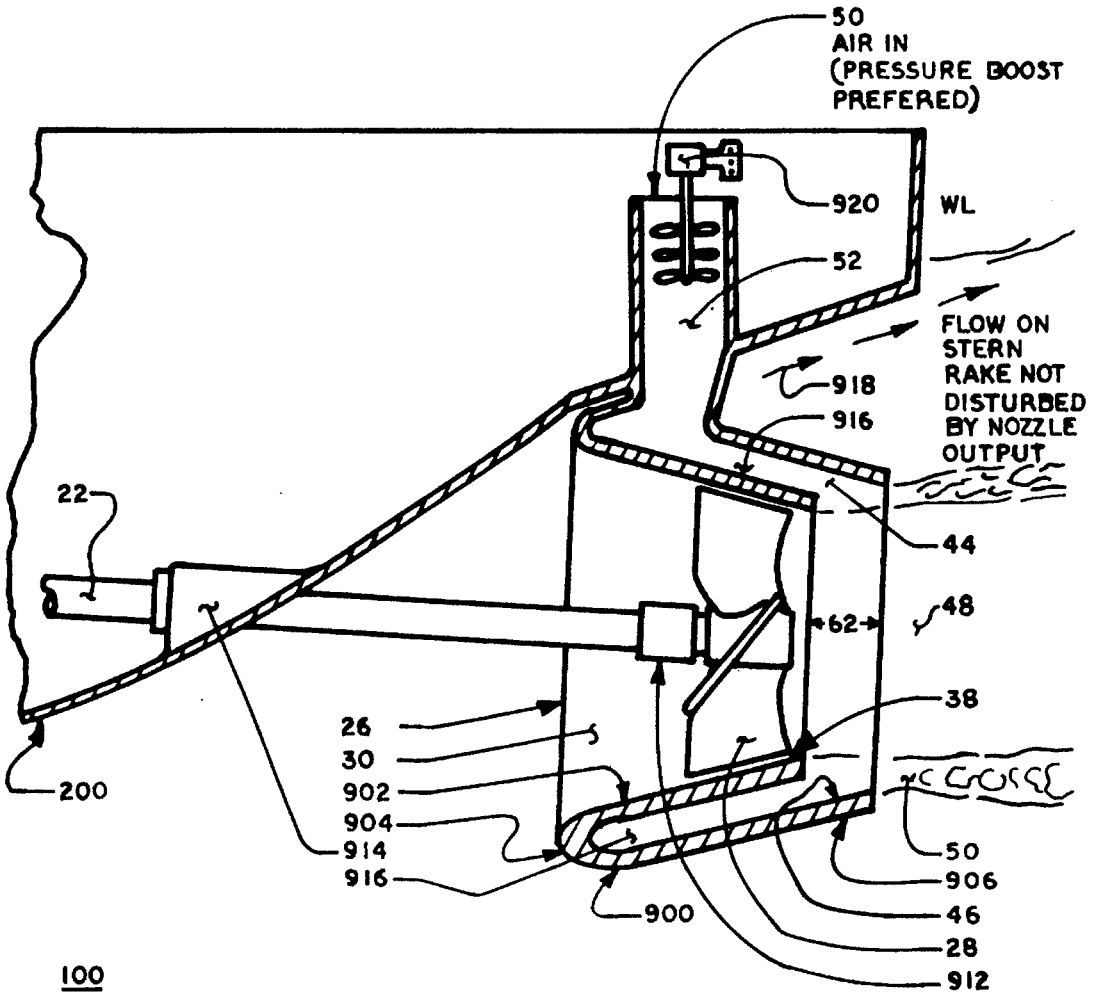
FIG. 16 is a cross-section taken on line 16—16 of FIG. 12 showing a housed or nozzled propeller incorporating the invention (see also FIG. 28).

In FIG. 16 (taken on line 16—16 of FIG. 12) is shown an annular shaped alternative housed propeller. This housing is an external nozzle 900 or hull (such as a Kort nozzle) consisting of an inside portion or hull 902 (usually tapered), a rounded leading edge 904 and a backwardly tapered plate 906. Portion 902, edge 904 and plate 906 may be formed together, and will define a cavity 916 wherein gases (air) 50 may be delivered by a tube 52 by a blower pump 920. Tubular shaped gaseous field 50, surrounding the jet stream 48 in sufficient volume at pressure, quiets the underwater propeller acoustical signature (when the propeller is under protection) and reduces the propensity of the outputted jet flow from educting or dragging water along with it. This reduces the velocity of the flow field about the after body of the vessel, and hence lowers the thrust deduction which may have been otherwise apparent in an unaided (non-gaseous tube surrounded) outputted jet stream 48 induced flow field. Similarly, as the vessel gains sufficient speed and the water sheet flow across the door reaches sufficient speed, the Haynes "anti-Coanda effect" cavity can have its door(s) deployed (see FIG. 31).

Figure 17:
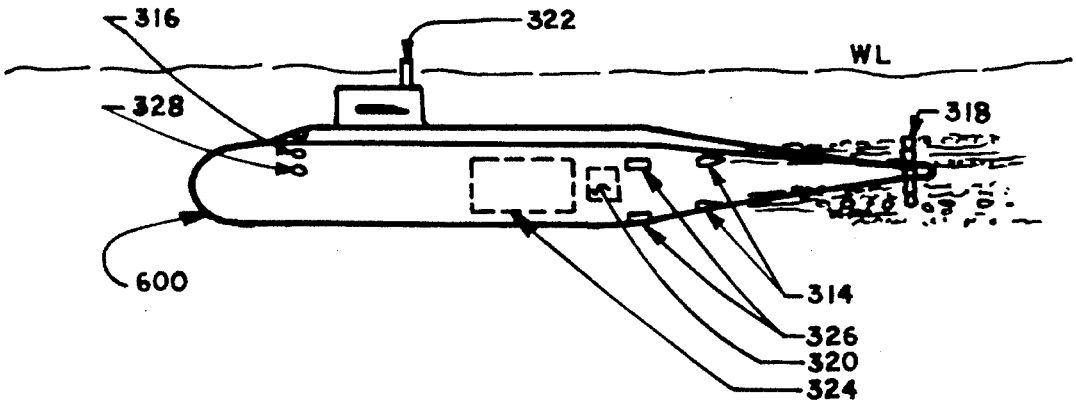
FIG. 17 is a plan view of a submersible water craft, such as a submarine, showing the position of the contained gas source, the location of the invention water jet drives for auxiliary propulsion, and the propeller main drive (a controllable pitch drive which is fully featherable during jet operation).

In FIG. 17 is shown a submersible, such as a torpedo or submarine, wherein the invention may be mounted. Such a form is specific to that craft, and also on certain types of surface powered sailing and engine cruising craft, such as SWATH (Small Water Plane Twin Hull craft) and wave piercing craft. Corona-Jet output nozzles 314 may be mounted in the aft portion of the submersible 600, as well as in the bow as bow jets 316. The submersible may be usually powered by a propeller (preferably a featherable controllable pitch system) 318, wherein the propeller 318 may be stopped during jet nozzle 314's operation. The power for jet nozzle water flow for nozzles of jets 314 and 316, as well as power for propeller 318, may be supplied by means known in the art from motive or motor power source 320. Gases for the water jet Corona-Jet nozzles may be supplied during surface running operations by a valved snorkel tube 322 or during submerged operation by a contained gas source 324, such as nuclear reactor steam and/or reacted chemicals. The main water jets are supplied with water through jet intakes 326 and the bow thruster is supplied through a jet intake 328. The intakes and discharges may occupy a segmented of the hull, or be fully annular, as in the case of a full axial flow jet system (jet stages and propeller stages independently decoupleable).

In environments where low noise levels are required, and/or in arctic ice conditions where they propeller may be damaged when operated around ice flows, the propeller 318 may be fully feathered and its blades aligned so they may act as rudders. Optionally, the propeller blades may be retracted into the propeller hub or they may be folded back in a fashion similar to folding propellers found in the art used on sailboats. The jets 314 may then be used for propulsion. If suitably placed, the bow thruster may be activated out both ports and used to drive off floating ice, and will provide a boundary layer of gaseous fluid against-the-hull at the waters surface as well as provide an outwardly directed current of water.

Similarly, the outwardly directed bow thruster jets may be used on oil spill "herding" operations, wherein the nozzle can be used on a multihull vessel, such as a catamaran, to herd the debris into a narrow pattern between the hulls, and suitable devices may be placed to pick or draw up the target material (such as oil) and concentrate it for suitable transportation to a collection site.

FIG. 20 is shown a hydrofoil craft running at high speed. Jet flow 48 is shown to be discharging at an angle just aft of amidship, preferably discharging between a pair of rudders, or less offensive, over a knife edge rudder. "T" shaped section and "I" shaped sections have been found favorable, with the flat substantially parallel portions of that shape being made into winglet hydrofoils that may support vessel weight. When the rudder is turned, this also columnates the jet flow and collects the vector force, and enhances steering. Also, air intake manifolds ducting through structural bulkheads are shown, wherein the air may be allowed in through small slots. This minimizes lost buoyancy when the chamber is flooded (see FIG. 23 for internal bulkhead "manifold" partitioning and joining above the water line, and "side" anti-Coanda generator door). This "bulkhead" technique can also be seen on FIG. 21. Generally, door lengths are designed to yield a maximum extension angle relative to the water line (at high speed) from full closed at hull form to 140 degrees on short flaps or doors, with between 6 degrees to 15 degrees relative to the water plane as being the planing running condition. Door length can be very short, as small as one percent of the boat length, to perhaps a length of 25% of the boat length (although this may vary significantly by vessel design and door design, and thereby should only be used to initiate experimentation). On long doors, a small trimming door (hydraulically activated) can be located for the full possible rotation scenario, with the larger "parent" door whereon it is mounted capable of only a deployment of, say, 20 degrees. The best size of the door, step, and gas cavity is determined by experiment.

In FIG. 22 (see also FIGS. 15, 23, and 28) can be seen an exaggerated plan view of a vessel hull. Doors 123 can be clearly seen, as well as the air supply manifold to the forward jet and ant-Coanda door system. Reverser valve 16 can be activated to supply water to the reverser jet nozzle. Reverse thrust is supplied if the reverser door 123 is open, drawing air into the Corona cavity through line 52 or 38. If the reverser door is closed, the water backs up the Corona cavity and flows up line 52 or 38, into the Bow Thruster Corona-Jet cavity. If bow thruster door 123 is open, then a force is generated through the open door. Similarly, if a door 123 (or plute 870) is closed, the fluidstream of concern (water or air) flow backs up the Corona cavity and flows to the next device in line (in one case the "ice lube outlet port"). The direction of flow is insured by the placement of check valves in the circuit, similarly the sealing of the flow from backing up into an unwanted portion of the airflow circuit is similarly done by check valve means (such as a high flow swing check valve system. Further, the circuit may be simplified by making the delivery trunk 38 above water line, wherein the end point (ice lube outlet port) could then be the Corona air intake for the bow thruster. If it is desired that the doors or flow plates be made tight sealing (and line 38 or 52 is above water line), then the unused portion of line 38 or 52 may be used as the Corona air supply line, and it may be possible to eliminate all check valves (the amount of fluid to be drained by the Corona suction on the at use through-hull is small).

In FIG. 22A is shown a door or flap 123 wherein its angle is adjusted between adjacent "mini-keel" members. The "mini-keel" members serve as air dams, e.g., to minimize the cross flooding of water into the Corona air chamber. In FIG. 22B is shown a flap or door 123 shaped like a "U" section. The edges of the "U" section fit into narrow slots in the hull, again thereby establishing the critical air dams or walls in the Corona air chamber. Air is let into the Corona air chamber through slots in the top of the chamber. The objective is to minimize lost buoyancy when the vessel is at rest, and to optimize the air flow into the chamber such as to establish the boundary layer separation layer (see also FIG. 20, 21, and 23).

FIG. 23 is showing the Corona Jet cavity partitioning zones within the cavity and the optional joining of the air supply above the water line. The gas supply can be valved (for manual or automatic operation) to vary the extent of supply to the Corona air charge region, and hense affect the pressure ratio in that region. The hull contours may be altered by moveable flaps of doors, and the gaseous boundry layer controlled in the wake of these devices, and thereby the resistive and lifting qualities (vector fields) of these regions can be selectively controlled at the discretion of the vessel operator, or suitably programmed controller device (such as a computer).

In FIG. 24 it can be seen that the door extension angle has a variety of positions which can affect the water resistance and load supporting properties of the hull relative to its center of mass. This can be resolved into separate lift-drag vector fields for each portion of the hull, and its appendages. This vectorfield changes with vessel speed, and with suitable judgement (possibly mechanically facilitated . . . e.g., sensors and computationally directed) can optimize door and/or foil extension angle. At high vessel speeds it is desirable to retract or drop the mast (and get the center of mass as close to the water plane as possible) thereby changing the natural frequency of the vessel (and reduce control system corrections in response to vessel wave riding and wave penetration behavior, e.g., pitching and heaving). The mast can be lowered by dropping the bow shroud line tensioning system (such as a pulley system and tie-off), or in a cantilever mast system, using a releasable locking device and a hydraulic cylinder. In any case, safety devices such as a position lock should be employed to prevent the mast from falling . . . and also the doors from retracting or falling in case of control failure. Other known retraction means may be employed. Note that a "U" shaped bracket is shown on the sides of the air intake tubes or pipes in FIG. 24, this facilitating the stowage of the mast, boom, sails, and rigging. These are then lashed down on dropping. The doors or flaps can also be used to correct for the vessel angle of heel into a turn (e.g., door on the inside of the turn with less angle of attack than the door on the outside of the turn). Further, the doors or flaps can correct for vessel rolling, e.g., stabilize the vessel rolling and heaving motion through the use of a motion sensor and appropriate response circuitry controlling the door angles.

In FIG. 24A is shown the position of the doors, wherein they are flush with the hull when retracted, and extended for hull planing (as shown). The jet intake is located in an extended keel which penetrates sufficiently below the water line (at highest service speeds) to insure proper pump suction supply. It is desired that the area ahead of the jet intake be a "V"ed hull form for air separation purposes (or an air separation shoe or chamber be employed in the region of the jet intake itself . . . such as the top port in the intake heat exchanger structure if Haynes U.S. Pat. No. 4,239,013 (issued 19 Dec. 1980). In this patent FIG. 48 a recess 148 directs the water into the heat exchanger region past apposing sides 150 and 152. The fluid is exited from a passageway 184 in an area aft of the jet intake. This recess 148 is useful in scooping up the compressed water surface foam which may be ahead of the jet intake, and separating it from the region which will be drawn into the pump for propulsion purposes. This recess can have an adjustable door on it similar to the jet intake door or reverser door in this applications FIG. 26, wherein the boundary layer "scooping" affect (and hull resistance) can be varied.

In FIG. 25 is a cross section of a Corona air chamber. Six (6) basic positions are shown out of many positions possible, e.g., 1) door "closed"(either water tight or with slight leakage to allow draining with increased vessel speed, 2) door "streamlined", wherein the door is opened enough that the pressure differential sensor located in a critical position detects the lowest differential pressure reading, 3) door in a "boundary layer enhancing" mode, wherein a gaseous boundary layer is being developed to change the wake and plate surface resistance characteristics of the vessel, 4) planing surface or trim tab mode (may be in combination with 3]above), wherein the attitude of the vessel or trim . . . may be changed in order to maximize some performance characteristic (the door or flap becomes a force exerting surface), and 5) spoiler or braking surface . . . wherein the door or flap must exert a varying amount of drag and lift . . . wherein it may go over vertical to a point 6) called rapid braking. These points are generally determined at sea trials and can be "mapped" for placing in a computers ROM (Read Only Memory). These points, as aforementioned, are correlated to a host of other inputs (such as load, speed, sea state, etc.).

FIG. 25A is a cross section of one species of hull using the described invention wherein the door is shown deployed in three positions 123A 123B 123C, and by virtue of vessel speed and a change in pressure distribution on the hull, a change in vessel trim is realized. The door is shown attached to a shaft at its pivot point (other known means may be used, such as a bridal which passes on the sides of the nozzle flow and attaches to the mid body or end of the door, and the bridal attaching actuation shaft passes through a sealing gland into the hull, and then attaches to an actuation means such as a hydraulic cylinder). The shaft runs through an ocean sealing means, such as a packing gland, and then is attached to a lever. The lever then is attached to an actuator, such as a hydraulic cylinder. The hydraulic cylinder is stroked to its desired position by a known hydraulic source and control means (indicated by "P", wherein fluid is supplied to one side of the cylinder and relieved from the other. At position, the ports on the cylinder are "hydraulic fluid locked" or sealed. A magnet or similar detectable means may be located on the hydraulic cylinder piston (indicated by "M"), wherein its position can be detected by a coil and appropriate detection circuitry (as available from most hydraulic control system manufacturers). In response to the detection circuitry, a spool shift command therefrom will cause a spool valve to let oil pressure to the appropriate side of the hydraulic cylinder, and relieve oil pressure from the apposing face. When the correct position is detected, the hydraulic spool valve will come to its centered "hydraulic lock" position, and the cylinder position may be held. Other known control means, such as stepping motors and encoders, can be used, thereby incorporating the machine tool control art and the aircraft automatic pilot adaptive control art in the application of this invention. Thereby, the cylinder can be stroked to a predetermined position, as well as detected (and corrected for) if oil leakage should cause a shift in position.

FIG. 25B is a cross section of the Corona cavity, (an upper plate and a lower plate) rotate about pivoting points, wherein adjustment of there position creates a change in the nozzle cross section as well as a change in the distribution of nozzle water streamline velocities (hense a change in average nozzle velocity and stream direction). The movement of the plates is shown by arrows. These horizontal plated are located between a pair of vertical plates (see FIG. 25C). The vertical plates can also have moveable sections which may affect sideways jet stream movement. Also shown by an arrow is the movement of the door 123 (it is shown in the closed position). Thusly, the jet water stream velocity and direction can be controlled such as to correct the distribution of the gaseous boundry layer flow speed with respect to boat speed and door deployment.

At extremely low speeds, an increased gaseous boundry layer mixing may be desired, as the rising layer against the vessel hull may contribute to propulsive force (although care must be taken to balance this against jet stream separation and Coanda losses). At low speeds a higher jet discharge stream angle may be desired, as a rising mixed plume no longer contributes to propulsion effort. The effort mixing the air boundry layer cannot efficiently be recovered. And the additional mixing can create excessive Coanda losses. A jet discharge angle complimentary with minimizing Coanda losses and thrust angle vector losses is desired. However, at higher speed, the gaseous boundary layer of the jet stream of a high angle jet fluid has a tendency to be "stripped", thereby requiring a change in nozzle angle, jet stream velocity, and door angle. The optimum combination is found by the instrumentation per the subject Haynes instrumentation patent.

The water jet intake is shown relative to the keel (see dashed lines in keel), as well as the downstream ports on the air separation means and heat exchanger means. Adjacent doors are shown with dashed lines.

FIG. 25D is a stern view of the vessel species of FIG. 25C showing all doors closed.

FIG. 26 is a cross section of a door, such as may be used in an Ice Lubrication, Oil Herding, Bow Thruster, Thrust Reverser, or similar application. It is shown in two positions, streamlined position and in the fully open position.

The doors may be controlled by any known means, such as a rotateable shaft at the door pivot point, an attaching strut and actuator means, etc. It should also be understood that a door flutter damping means may also be attached to the door, such as a hydraulic shock absorber, rubber snubber with preloading device (such as an attached hydraulic cylinder with pressure sensor), and electro/hydraulic and electronic flutter cancelling system (whereon an opposing pressure is applied to a hydraulic cylinder in response to an adversely deflecting pressure).

While a specific embodiment of an improved marine propulsion motor and propulsion system associated therewith have been disclosed in the foregoing description, it will be understood that various modifications within the spirit of the invention may occur to those skilled in the art. Therefor, it is intended that no limitations be placed on the invention except as defined by the scope of the appended claims.

What is claimed is:

1. In combination with a marine craft including a hull having a submerged surface portion within which a discharge opening is formed, including a displaceable jacket means having a predetermined passage width and length in enclosing relation to the gas flow stream, a source of gas, and means for introducing gas into the jacket to form a gaseous boundary layer in a sheet surface relation to the hull plate downstream of said displaceable jacket means, comprising means for pressurizing the gas within the jacket, and means mounting the jacket in operative relation to the hull and the discharge opening for the formation of the gaseous boundary layer against-the-hull.

2. In combination with a marine craft including a hull having a submerged surface portion or submersible portion or external housing, within which a first discharge opening is formed, for discharging a gaseous flow stream from a discharge opening along a discharge path, including a jacket means having a predetermined passage diameter or width and length, which may occupy a segment of the hull, or be fully annular, with width and length in enclosing relation to a gaseous flow stream, a source of gas, and means for introducing gas into a jacket to form a gaseous layer in an against-the-hull surface relation downstream of said jacket means, comprising means for pressurizing the gas within the jacket, and means mounting the jacket in operative relation to the hull and a discharge opening for the formation of a gaseous boundary layer against-the-hull, and, in combination with said hull having a submerged surface portion or submersible portion or external housing, a second discharge opening for a thrust jet stream propelling means, which may occupy a segment of the hull, or be fully annular, or be an external housing, for discharging a thrust jet stream of water from a discharge opening along a discharge path, with a diameter or width and length in enclosing relation to said thrust jet stream of water, including a nozzle from which said thrust jet stream of water emerges, a jacket having a passage diameter or width and length in an enclosing relation to said thrust jet stream of water, a source of gas, and means for introducing gas into a jacket to form a gaseous boundary layer in surrounding relation to the thrust jet stream and against-the-hull, comprising means for pressurizing a gas within a jacket, and means mounting a nozzle in operative relation to a jacket and a discharge opening for the formation of a gaseous boundary layer against the hull and extending said gaseous boundary layer therefrom under said predetermined pressure externally of the hull for expansion relative to the thrust jet stream under suction pressures developed externally on the surface portion of the hull.

3. In combination with a marine craft including a hull having a submerged surface portion or submersible portion or external housing, within which a discharge opening is formed, and a thrust jet stream propelling means for discharging a thrust jet stream of water from a discharge opening along a discharge path, including a nozzle from which a thrust jet stream emerges, a first jacket means having a passage diameter or width and length in relation to a discharge opening on a surface portion of the hull, a second jacket having a passage diameter or width and length in a surrounding relation to a thrust jet stream, a source of gas, and means for introducing gas into said jackets to form a gaseous boundary layer in an against-the-hull relation and around a thrust jet stream, comprising means for pressurizing a gas within a jacket, and means mounting a nozzle in operative relation to said jackets and said discharge openings for the formation of a gaseous boundary layer against-the-hull and extending said gaseous boundary layer therefrom externally of the hull for expansion relative to the water flow under suction pressures developed externally on the surface portion of the hull, wherein a said second jacket output point is connected to a said first jacket output point, and the closure of a flap or door or valve or flow plate is able to force the fluid stream of concern back up into the Corona air pipe or manifold and to the next said jacket output point in the circuit.

4. A unit as in any one of claims 1–3 inclusive, in which a jacket or gas cavity has an attached flow plate or flap or door which is extendable over a range of positions from the closed position to a braking position.

5. A unit as in claim 4, in which said flow plates or flaps or doors are segmented.

6. A unit as in claim 4, in which said flow plates or flaps or doors are independently controllable.

7. A unit as in claim 4, in which said flow plate(s) or flap(s) or door(s), or nozzle(s), can be controlled adaptively in response to feedback from sensors.

8. A unit as in any one of claims 1–3 inclusive, in which the gas passageway contains check valves to insure the one-way passage of the fluid stream of concern.

9. A unit as in any one of claims 1–3 inclusive, in which a gas passageway is a cavity between two adjacent bulkheads.

10. A unit as in claim 4, in which said door or flap is a plate moveable between pairs of mini-keels.

11. A unit as in claim 4, in which said door or flap is a U shaped plate which draws up between female cavity pairs.

12. A unit as in claim 4, in which said door or flap can move inwardly.

13. A unit as in any one of claims 1–3 inclusive, in which a jet intake contains an air separation means.

14. A unit as in any one of claims 1–3 inclusive, in which gas cavity passageways are segmented.

15. A unit as in any one of claims 1–3 inclusive, in which gas cavity passageways are connected above the waterline.

* * * * *